US010571219B2

(12) United States Patent
Wilson et al.

(10) Patent No.: US 10,571,219 B2
(45) Date of Patent: Feb. 25, 2020

(54) FOREARM PISTOL BRACE

(71) Applicant: Sig Sauer, Inc., Newington, NH (US)

(72) Inventors: John Wilson, East Waterboro, ME (US); Luke Morenz, Swanzey, NH (US); Mark Kimball, Exeter, NH (US); Chris D'Alfonso, Exeter, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 16/032,493

(22) Filed: Jul. 11, 2018

(65) Prior Publication Data

US 2019/0017777 A1 Jan. 17, 2019

Related U.S. Application Data

(60) Provisional application No. 62/531,111, filed on Jul. 11, 2017.

(51) Int. Cl.

| | |
|---|---|
| ***F41C 33/00*** | (2006.01) |
| ***F41C 23/12*** | (2006.01) |
| ***F41C 23/04*** | (2006.01) |
| ***F41C 23/14*** | (2006.01) |
| ***F41C 27/22*** | (2006.01) |

(52) U.S. Cl.

CPC ..... *F41C 33/001* (2013.01); *F41C 23/04* (2013.01); *F41C 23/12* (2013.01); *F41C 23/14* (2013.01); *F41C 27/22* (2013.01)

(58) Field of Classification Search

CPC ..... F41C 23/04; F41C 23/10; F41C 23/12; F41C 23/14; F41C 27/22; F41C 33/001

See application file for complete search history.

(56) References Cited

U.S. PATENT DOCUMENTS

| | | | | |
|---|---|---|---|---|
| 3,162,966 A * | 12/1964 | La Coss | F41C 23/12 42/106 |
| 3,184,877 A * | 5/1965 | Andrews | F41C 23/12 42/72 |
| 3,213,869 A * | 10/1965 | Frank | A61H 3/02 135/71 |
| 3,648,396 A * | 3/1972 | Smith | F41C 23/12 42/72 |

(Continued)

OTHER PUBLICATIONS

Jonathan Owen, "Tailhook Pistol Brace—Gear Head Works Changes the Pistol vs. SBR Game in 2017", Retrieved online Jun. 5, 2017, URL: http://shwat.com/tailhook-pistol-brace-gear-head-works-changes-the-pistol-brace, 7 pages.

(Continued)

*Primary Examiner* — Joshua T Semick

(74) *Attorney, Agent, or Firm* — Finch & Maloney PLLC

(57) ABSTRACT

A pistol brace for a pistol having a frame with a rear end portion and defining a median plane longitudinally through the pistol. The pistol brace has a longitudinal support configured to attach to and extend rearwardly from the pistol frame. A first plate and a second plate are pivotably attached at an upper end portion to the longitudinal support and extend down from the support in opposed alignment. The first plate and second plate can pivot independently of each other. Optionally, a flexible strap is connected to the first plate and second plate. The strap defines an adjustable passageway for the user's forearm.

19 Claims, 16 Drawing Sheets

(56) References Cited

U.S. PATENT DOCUMENTS

| | | | | |
|---|---|---|---|---|
| 4,291,482 | A * | 9/1981 | Bresan | F41C 23/14 42/72 |
| 4,735,007 | A * | 4/1988 | Gal | F41C 23/04 42/7 |
| 6,016,620 | A * | 1/2000 | Morgan | F41C 27/00 42/94 |
| 7,028,427 | B2 * | 4/2006 | Crawford | F41C 33/001 42/72 |
| 7,398,616 | B1 * | 7/2008 | Weir | F41C 23/04 42/71.01 |
| 8,061,072 | B1 * | 11/2011 | Crose | F41C 23/04 42/71.01 |
| 8,869,444 | B2 | 10/2014 | Bosco | |
| 8,910,407 | B2 * | 12/2014 | Singh | F41C 23/12 42/71.02 |
| 9,354,012 | B2 * | 5/2016 | Faifer | F41A 23/10 |
| 9,354,021 | B2 * | 5/2016 | Bosco | F41C 33/001 |
| D774,618 | S * | 12/2016 | Bosco | D22/108 |
| D780,279 | S * | 2/2017 | Bosco | D22/108 |
| 9,664,477 | B1 * | 5/2017 | Reavis, III | F41C 27/22 |
| 9,829,272 | B2 * | 11/2017 | Brown | F41C 23/04 |
| 10,041,760 | B2 * | 8/2018 | Keller, II | F41C 23/14 |
| 10,054,393 | B2 * | 8/2018 | Kedairy | F41C 23/04 |
| 2008/0072943 | A1 * | 3/2008 | Forster | A61H 3/0244 135/71 |
| 2018/0238359 | A1 * | 8/2018 | Cross | F16B 2/065 |
| 2019/0063869 | A1 * | 2/2019 | Keller | F41C 23/12 |

OTHER PUBLICATIONS

"Gill Arm Lock for Glock Pistols", Gill Firearms, retrieved on Jun. 2017, 2 pages.

* cited by examiner

FOREARM PISTOL BRACE

RELATED APPLICATIONS

This application claims priority under 35 U.S.C. § 119(e) to U.S. Provisional Patent Application No. 62/531,111 titled FOREARM PISTOL BRACE, and filed on Jul. 11, 2017, the contents of which are incorporated herein by reference in its entirety.

BACKGROUND

The present disclosure relates generally to firearm accessories and, more specifically, to an improved forearm brace for a handgun.

Firearm design involves many non-trivial challenges, including the design of grips and stocks to facilitate the user in having a stable position for discharging the firearm. Some considerations related to the design of submachine guns and handguns address a stock, brace, or other feature that aids the user in stabilizing the firearm during use.

SUMMARY

The embodiments described in the present disclosure relate to a pistol brace for use with a pistol or handgun, where the pistol brace is configured to stabilize the firearm when it is held or fired by the user.

Accordingly, one aspect of the present disclosure is directed to a pistol brace configured to attach to a pistol. In one embodiment, a pistol brace is configured for use with a pistol having a frame with a rear end portion. The pistol brace has a longitudinal support configured to attach to the frame of the pistol and extend rearwardly from the pistol generally along a median plane of the pistol. A first plate and a second plate are pivotably attached to the longitudinal support. The first plate has a first plate upper end portion and a first plate body, where the first plate upper end portion is pivotably attached to the longitudinal support with the first plate body extending transversely from the longitudinal support. The first plate is pivotable about a first pivot axis extending through the first plate upper end portion. The second plate has a second plate upper end portion and a second plate body, where the second plate upper end portion is pivotably attached to the longitudinal support with the second plate body extending transversely from the longitudinal support in opposed alignment with the first plate. The second plate can pivot about a second pivot axis extending through the second plate upper end portion, where the second plate pivots independently of the first plate.

In some embodiments, the first pivot axis is distinct from the second pivot axis. For example, the first pivot axis is laterally spaced from the second pivot axis. In other embodiments, the first pivot axis is the same as the second pivot axis. For example, the first plate and the second plate pivot about the longitudinal support, such as when the pivot axis is the central axis of the longitudinal support.

In some embodiments, a proximal end portion of the longitudinal support includes a mounting post received through the first plate upper end portion and the second plate upper end portion.

In some embodiments, the pistol brace includes a flexible strap attached to the first plate lower end portion and the second plate lower end portion. The flexible strap at least in part defines a forearm passageway sized for a forearm of a user when the first plate lower end portion and the second plate lower end portion are pivoted apart from each other in an open position. In some embodiments, the flexible strap is permanently secured to at least one of the first plate and the second plate. The flexible strap can be used to define a releasable and/or adjustable closed loop.

In some embodiments, the longitudinal support comprises a first rod and a second rod extending in a spaced-apart parallel relationship. In some embodiments, the pistol brace includes a mounting bracket attached to the first rod and the second rod, where the mounting bracket slidably receives the first rod and the second rod, thereby permitting the first plate and the second plate to be moved between (i) a stowed position in which the first plate and the second plate are positioned adjacent the mounting bracket, and (ii) an extended position in which the first plate and the second plate are extended rearwardly from the mounting bracket by the longitudinal support. In some embodiments, the first rod is received by the first plate upper end portion and defines the first pivot axis, and wherein the second rod is received by the second plate upper end portion and defines the second pivot axis.

In some embodiments, the pistol brace includes a brace body secured to a proximal end portion of the longitudinal support, where the first plate and the second plate pivotably attach to the brace body. For example, the brace body extends laterally of the longitudinal support and defines the first pivot axis and the second pivot axis on opposite sides of the median plane. In some embodiments, the brace body is secured to a proximal end portion of the longitudinal support and includes a mounting post that is received through the first plate upper end portion and the second plate upper end portion.

In another embodiment, the pistol brace includes a mounting bracket attached to the longitudinal support and configured to engage the frame of the pistol. In one embodiment, the mounting bracket is configured to engage a mounting rail on the rear end of the pistol. For example, the mounting rail is a MIL-STD 1913 rail or "Picatinny" rail.

In another embodiment, a mounting bracket is attached to the first rod and the second rod, where the mounting bracket slidably receives the first rod and the second rod, thereby permitting the first plate and the second plate to be moved between (i) a stowed position in which the first plate and the second plate are positioned adjacent the mounting bracket, and (ii) an extended position in which the first plate and the second plate are extended rearwardly from the mounting bracket by the longitudinal support. In one embodiment, the first rod and the second rod are spaced sufficiently to extend alongside the frame of the pistol when the pistol brace is attached to the pistol with the first plate and the second plate in the stowed position.

In some embodiments, one or both of the first plate and the second plate has a fixed position relative to the median plane. For example, the fixed position is releasable. In one embodiment, the fixed position is a closed position with a first inside surface of the first plate facing and closely adjacent a second inside surface of the second plate. For example, the closed position is selectively lockable by a brace locking assembly.

In some embodiments, the pistol brace includes a pistol connected to a distal end portion of the longitudinal support. For example, the pistol has a lower receiver and an upper receiver and is selected from (i) a submachine gun, (ii) a pistol-caliber carbine, (iii) a short-barreled rifle, and (iv) a handgun.

Further aspects, advantages and areas of applicability will become apparent from the description provided herein. It should be understood that the description and specific examples are intended for purposes of illustration only and are not intended to limit the scope of the present disclosure.

Figure 1:
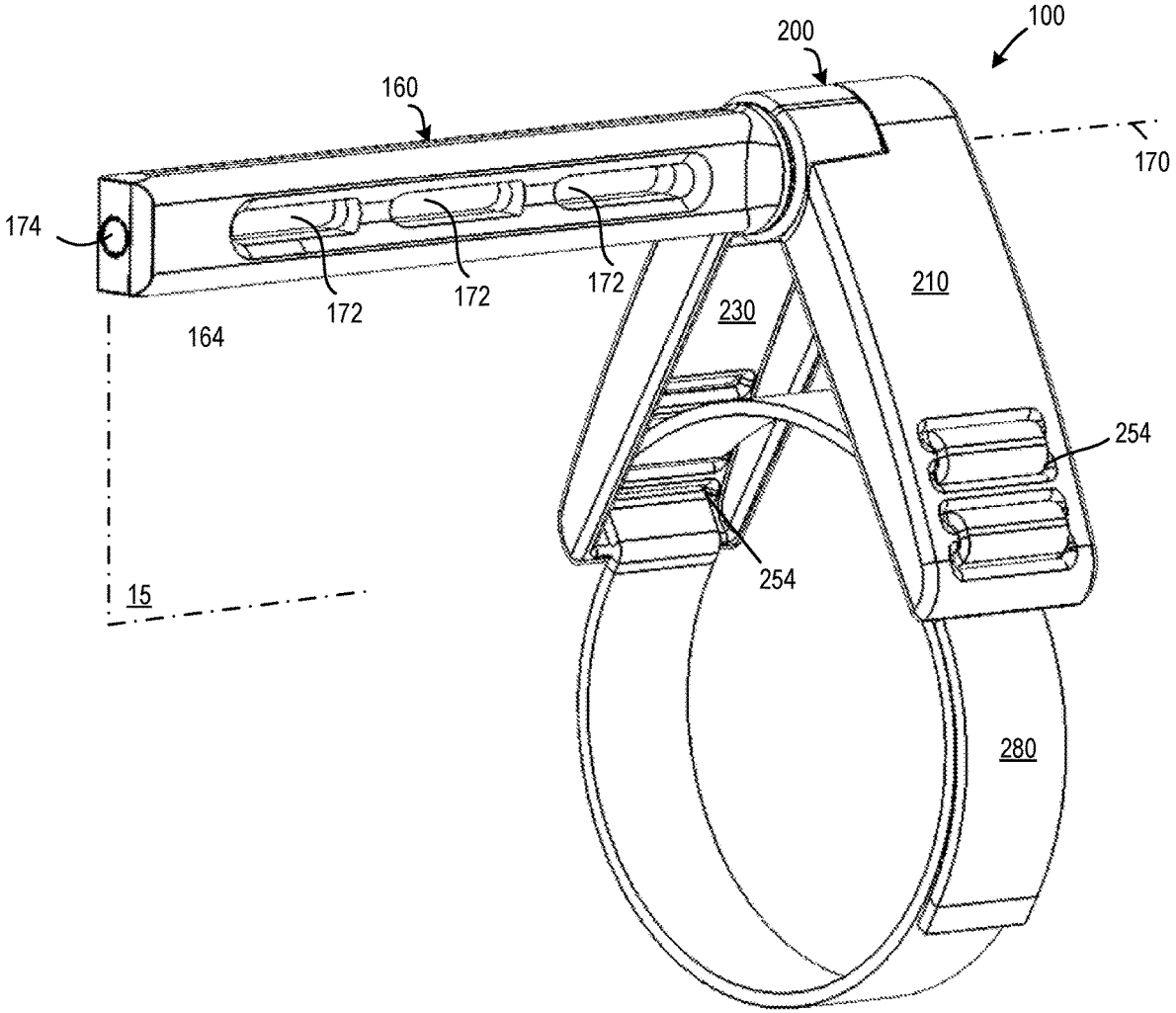
FIG. 1 illustrates a front perspective view of a pistol brace with a longitudinal support and a brace portion with flexible strap, in accordance with one embodiment of the present disclosure

The figures depict various embodiments of the present disclosure for purposes of illustration only. Numerous variations, configurations, and other embodiments will be apparent from the following detailed discussion.

DETAILED DESCRIPTION

The following description is merely exemplary in nature and is not intended to limit the present disclosure, application, or uses. As will be seen, the devices and methods taught herein offer a pistol brace that aids the user in stabilizing a pistol or handgun. The Gun Control Act of 1968 (GCA) defines a pistol as a weapon originally designed, made, and intended to fire a projectile (bullet) from one or more barrels when held in one hand, having a chamber(s) as an integral part of, or permanently aligned with, the bore(s), and a short stock designed to be gripped by one hand at an angle to and extending below the line of the bore(s). The National Firearms Act (NFA) defines a short-barreled rifle as a shoulder-fired gun with a barrel shorter than 16 inches (41 cm) or an overall length of less than 26 inches.

For the purposes of the present disclosure, the term pistol or handgun means a firearm intended to be fired from one's hand or hands without being braced against the user's shoulder, including but not limited to pistols defined under the GCA, short-barreled rifles defined under the NFA, semi-automatic firearms having a barrel shorter than 16 inches, and rifles assembled or converted to a pistol or short-barreled rifle. The terms pistol and handgun may be used interchangeably.

A forearm-gripping stabilizing attachment by SB Tactical includes an attachment body with an upper portion defining a passage extending longitudinally therein. The passage in the upper portion of the attachment telescopically receives the buffer tube or other suitable tubular support structure extending rearwardly from a handgun. The lower portion of the attachment body is longitudinally bifurcated with downwardly-depending opposed flaps to receive and grip the user's forearm along the buffer tube. The flaps are laterally spaced and form a gap therebetween for the forearm of a user with the flaps disposed on opposite lateral sides of the user's forearm. The attachment may have a fabric strap that encircles the flaps and the user's forearm and may be cinched tight to secure the attachment to the user's forearm. The forearm-gripping stabilizing attachment maintains the user's forearm positioned below and extending along the buffer tube or other support structure.

By gripping the user's forearm along the buffer tube, the forearm-gripping stabilizing attachment discussed above maintains the user's forearm aligned with the median plane of the handgun. However, this forearm position conflicts with proper sight alignment of conventional shooting positions. For example, in one conventional shooting position, the user assumes an isosceles stance with the handgun held in an upright position in front of the body at eye level. To align one's eye with sights along the barrel, the user's wrist must be slightly extended so that the forearm(s) deviate laterally from the median plane as the arm(s) extends rearwardly to the shoulder. Therefore, when using the forearm-gripping stabilizing attachment of the prior art while in the isosceles position or other conventional shooting positions, the user must cant the handgun to align the user's eye with sights along the barrel. Canting the pistol, however, is generally less accurate because the sights are set up for an upright orientation. As such, corrections for windage and elevation become errors when the handgun is canted. When using the forearm-gripping stabilizing attachment of the prior art with the pistol in an upright position, the user may shoot from the hip (without sights) or shoot one-handed with the arm outstretched to the side of the body. Thus, by maintaining the user's forearm along the median plane of the handgun, the forearm-gripping stabilizing attachment of the prior art interferes with proper sight picture and sight alignment and in turn reduces the user's ability to shoot accurately.

A pistol brace by KAK Industries has a plate attached to and extending vertically down from the buffer tube of pistols based on the AR-platform and the like. The user's forearm rests against the flat, vertical surface of the plate while shooting. However, the vertical plate provides little actual support to counteract muzzle drop of the pistol since the plate is positioned for lateral forces, not vertical forces. When the handgun is held upright in a conventional shooting position in front of the user, the forces of the handgun act vertically in line with the plate rather than acting sideways against the plate. Therefore, the attachment is merely a vertical blade against which little or no force is exerted when the handgun is used in a conventional position.

In addition to the deficiencies discussed above, the strap of some prior-art pistol braces is exposed and subjected to wear and tear during use and when the brace is not being used. Even in controlled environments, the strap can become frayed or worn. Such a design necessitates having the strap configured for easy removal so that it may be replaced when worn. Unfortunately, a removable strap facilitates improperly using the pistol brace as a stock for shoulder-firing the firearm. By doing so, the user may inadvertently violate the NFA's provisions on short-barreled rifles.

Considering the deficiencies of other brace designs, a need exists for an improved forearm pistol brace. Embodiments of the present disclosure are directed to an improved pistol brace. In some embodiments, a pistol brace aids the user in stabilizing the firearm during use, enables proper sight alignment in conventional shooting positions, and provides support to counteract muzzle drop of barrel-heavy pistols.

As will be appreciated in light of this disclosure, and in accordance with some embodiments, a pistol brace configured as described herein can be utilized with any of a wide range of host firearms, such as, but not limited to, a pistol, a submachine gun, a carbine, and a short-barreled rifle. In accordance with some example embodiments, a pistol brace configured as described herein can be utilized with host firearms chambered for pistol or rifle ammunition. Suitable host firearms include firearms based on AR-15, AK-47, SCAR and other platforms. Some pistol platforms have, for example, a firearm lower receiver with a magazine well positioned in front of the trigger and hand grip, an upper receiver that assembles with the lower receiver and houses a bolt carrier group with a charging handle. An example of one suitable pistol is the SIG MPX® Pistol by Sig Sauer, Inc., a semiautomatic pistol chambered in 9 mm Luger with an eight-inch barrel and an overall length of about seventeen inches. Other suitable host firearms and projectile calibers will be apparent in light of this disclosure.

In accordance with some embodiments, use of the disclosed apparatus may be detected, for example, by visual inspection of a pistol brace having features such as opposed bolsters or plates that pivot independently of each other, the ability to position the user's forearm laterally from the median plane of the pistol, and a flexible strap that can be stowed between the opposed plates. Also, it should be noted that, while generally referred to herein as a pistol brace for consistency and ease of understanding the present disclosure, the disclosed pistol brace is not limited to that specific terminology and alternatively can be referred to, for example, as a forearm brace, a stabilizing attachment, a forearm pistol brace, or other terms. As will be further appreciated, the particular configuration (e.g., materials, dimensions, etc.) of a pistol brace configured as described herein may be varied, for example, depending on whether the intended use is military, tactical, law enforcement, or civilian in nature. Numerous configurations and advantages will be apparent in light of this disclosure.

Structure and Function

Referring to FIG. 1, a perspective view shows a forearm pistol brace 100 in accordance with an embodiment of the present disclosure. Pistol brace 100 includes a longitudinal support 160 attached to a brace portion 200 that includes a first bolster or first plate 210 and second bolster or second plate 230. First plate 210 and second plate 230 are pivotably attached to longitudinal support or an attachment thereto, such as a brace body, mounting post, bracket, extension, or other assembly. An optional flexible strap 280 is threaded through openings in first plate 210 and second plate 230 to define an adjustable closed loop that can encircle a user's forearm. The strap can be tightened around the user's forearm to secure pistol brace 100.

In one embodiment, longitudinal support 160 has a beam-like construction with a generally rectangular cross-sectional shape. For example, the cross-sectional shape can be a square or rectangle with rounded corners. Optionally, longitudinal support 160 defines one or more openings 172 extending transversely therethrough to reduce weight. Some such openings 172 can have an elongated slot shape for use as a sling mount or strap passageway, as will be appreciated. A support first end portion 164 (e.g., distal end portion) is constructed for attachment to a mounting bracket 110 (shown in FIG. 2). For example, longitudinal support 160 defines one or more threaded fastener openings 174 that extend axially into support first end portion 164. A fastener can be installed through the mounting bracket 110 and into the fastener opening(s) 174 to secure mounting bracket 110 to longitudinal support 160, for example. A support second end portion 166 (e.g., proximal end portion) has a mounting post 206 constructed to mount brace portion 200.

When installed on mounting post 206, such as shown in FIG. 1, first plate 210 and second plate 230 extend down from longitudinal support 160 in opposed alignment and can rotate or pivot about mounting post 206 between an open position and a closed position. In one embodiment, first plate 210 and second plate 230 can pivot independently of each other about a common pivot axis 170. For example, in one embodiment, pivot axis 170 is common to a central axis of longitudinal support 160; in other embodiments, pivot axis 170 can be offset vertically or in some other direction from a central axis of longitudinal support 160. In the open position, such as shown in FIG. 1, one or both of first plate 210 and second plate 230 may pivot away from a median plane 15 extending through pistol 10 and longitudinal support 160. In the closed position, first plate 210 and second plate 230 pivot towards each other so that first plate 210 and second plate 230 are closely adjacent or abut one another. In the closed position of some embodiments, the flexible strap 280 can be retained in a folded configuration in a cavity defined between first plate 210 and second plate 230.

Figure 2:
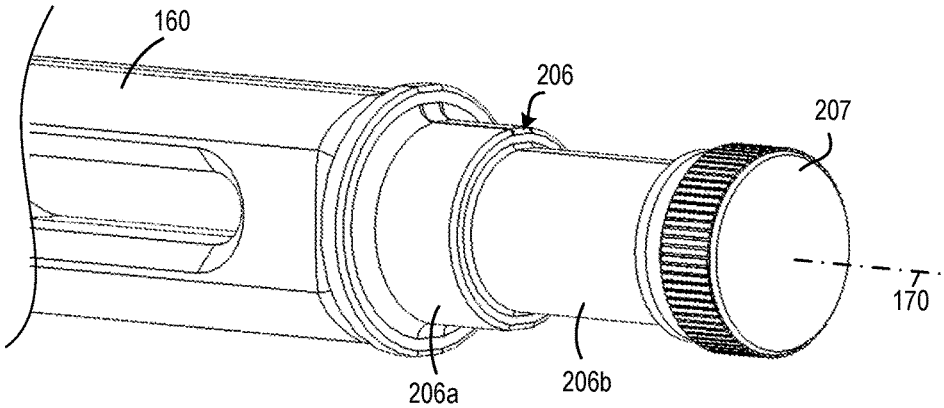
FIG. 2 illustrates a rear perspective view of part of the longitudinal support, showing the mounting post for the brace portion, in accordance with an embodiment of the present disclosure.

Referring to FIG. 2, a rear perspective view illustrates part of longitudinal support 160 with mounting post 206 extending therefrom along pivot axis 170, in accordance with one embodiment of the present disclosure. In one embodiment, mounting post 206 is generally cylindrical and has a first section 206*a* of greater diameter and a second section 206*b* of reduced diameter. A fastener cap 207 covers a fastener 122 (shown in FIG. 5) installed into second section 206*b*. In one embodiment, fastener cap 207 has a greater outer diameter than second section 206*b*. For example, the outer diameter of fastener cap 207 is the same or about the same as the diameter of first section 206*a* of mounting post 206. As such, fastener cap 207 can be used to complete a generally symmetrical profile along mounting post 206 with a region of reduced diameter (second section 206*b*) between regions of larger diameter (first section 206*a* and fastener cap 207).

Figure 3A:
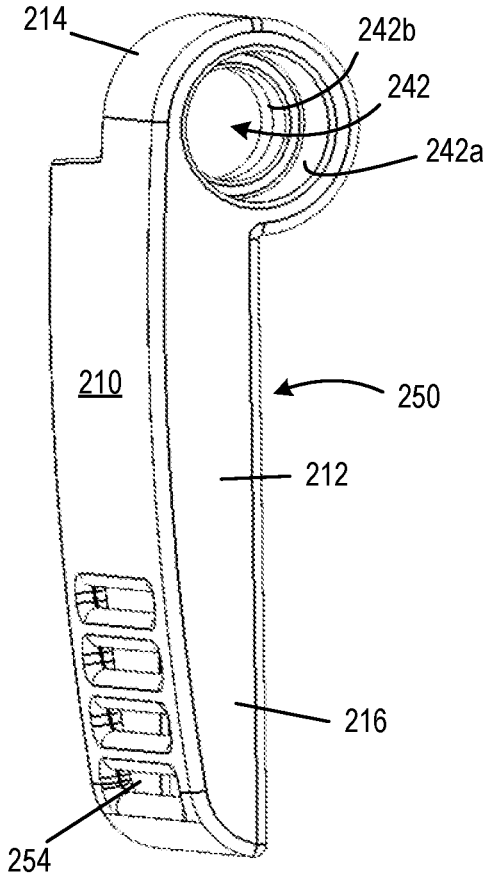
FIGS. 3A and 3B illustrate rear perspective views of first and second plates or bolsters of the brace portion, in accordance with an embodiment of the present disclosure.
Figure 3B:
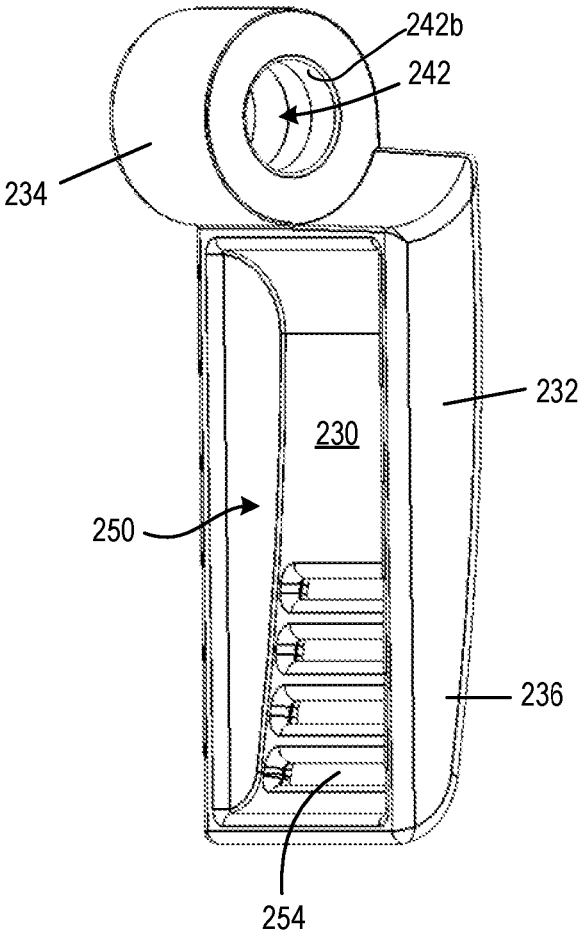

Referring now to FIGS. 3A and 3B, perspective views illustrate first plate 210 and second plate 230. In one embodiment as illustrated, first plate 210 and second plate 230 are identical in shape and are constructed to be positioned against one another in a face-to-face orientation when brace portion 200 is in the closed position. For example, first plate 210 and second plate 230 are positioned with inside portions facing each other and upper end portions 214, 234 overlapping one another. First plate 210 has a first plate upper end portion 214 constructed to receive mounting post 206 therethrough. First plate upper end portion 214 connects to a first plate body 212 with a first plate lower end portion 216. Second plate 230 is similarly constructed with second plate upper end portion 234 connected to second plate body 232 with a second plate lower end portion 236. In some embodiments, first plate body 212 and second plate body 232 are hollow or otherwise define a cavity or strap recess 250. For example, the strap recess 250 is sized to accommodate the flexible strap 280 in a folded configuration when brace portion 200 is in the closed position. In some embodiments, first plate lower end portion 216 and second plate lower end portion 236 define one or more strap openings 254. As shown in FIG. 1, for example, flexible strap 280 can be threaded through strap openings 254 to define a closed loop that releasably closes and/or adjusts in circumference to accommodate the forearm of the user.

In one embodiment, first plate upper end portion 214 has a cylindrical shape defining a pivot opening 242 with a larger portion 242*a* and a smaller portion 242*b*. Larger portion 242*a* of pivot opening 242 corresponds to and receives first section 206 (larger portion) of mounting post 206. Smaller portion 242*b* of pivot opening 242 corresponds to and is sized to receive second section 206*b* (smaller portion) of mounting post 206. When assembled as shown in FIG. 1, for example, first section 206*a* of mounting post 206 functions as a spacer or stop for second plate 230. Fastener cap 207 is received in larger portion 242*a* of the pivot opening 242 of first plate 210 and similarly functions as a spacer or stop for first plate 210. Second section 206*b* of mounting post 206 is received through both of the smaller portions 242*b* of the pivot openings 242 through first plate 210 and second plate 230.

In one embodiment, first plate upper end portion 214 is connected to a rear portion of first plate body 212. Since second plate 230 is identical in some embodiments, second plate upper end portion 234 can overlap first plate upper end portion 214 with pivot openings 242 aligned. For example, first plate upper end portion 214 and second plate upper end portion 234 function like a hinge, where mounting post 206 acts like a hinge pin. First plate body 212 and second plate body 232 can then rotate about mounting post 206 between the open position and the closed position.

Figure 4:
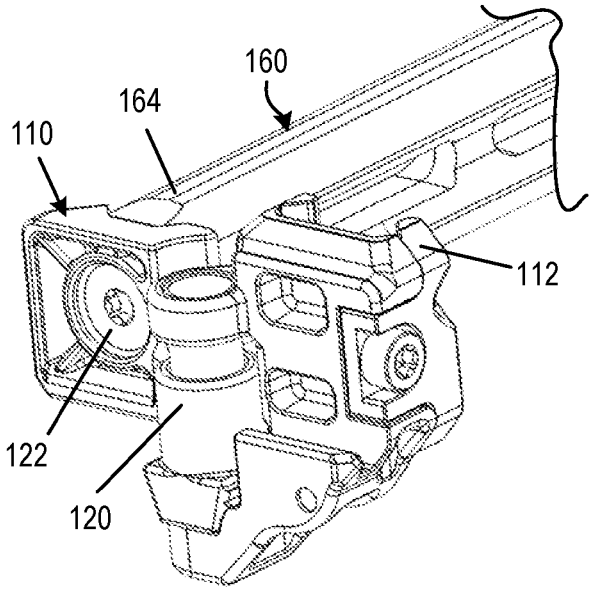
FIG. 4 illustrates a rear perspective view of a mounting bracket attached to the longitudinal support and folded to an open position, in accordance with an embodiment of the present disclosure.

Referring now to FIG. 4, a perspective view illustrates one embodiment of a mounting bracket 110 secured to support first end portion 164 using a fastener 122. Mounting bracket 110 is configured to fold between an open position and a closed position. Mounting bracket 110 includes an attachment feature 112, such as a clamp or the like, to secure to an accessory mounting rail 16 on rear end 12 of pistol 10. In the open position as shown in FIG. 4, longitudinal support 160 is folded 180° from is deployed position in which it extends rearwardly from pistol 10 along median plane 15. As such, pistol brace 100 can be folded along the side (e.g., left side) of pistol frame 14. In the closed position of mounting bracket 110, longitudinal support 160 pivots about hinge 120 so that longitudinal support 160 extends rearwardly from pistol 10. Mounting bracket 110 may be retained or locked in the closed position through use of a snap fit, catch, latch, fastener, or other suitable means of fixing the closed position.

Figure 5:
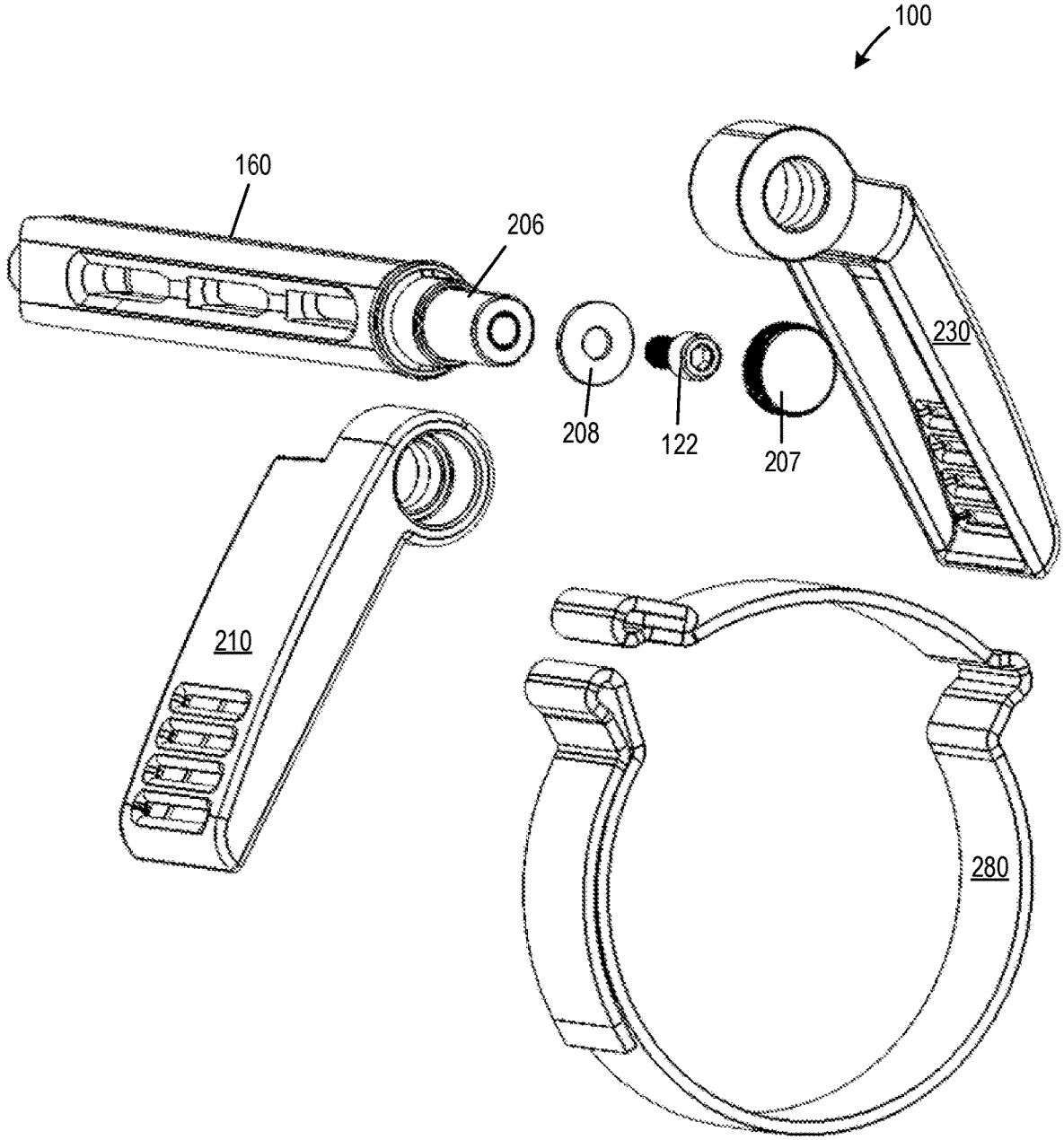
FIG. 5 illustrates an exploded, rear perspective view showing components of the pistol brace of FIG. 1.

FIG. 5 illustrates an exploded, rear perspective view showing components of pistol brace 100 in accordance with one embodiment. Pistol brace 100 includes longitudinal support 160 with mounting post 206, first plate 210, second plate 230, fastener 122 with fastener cap 207 and washer 208, and flexible strap 280.

Figure 6:
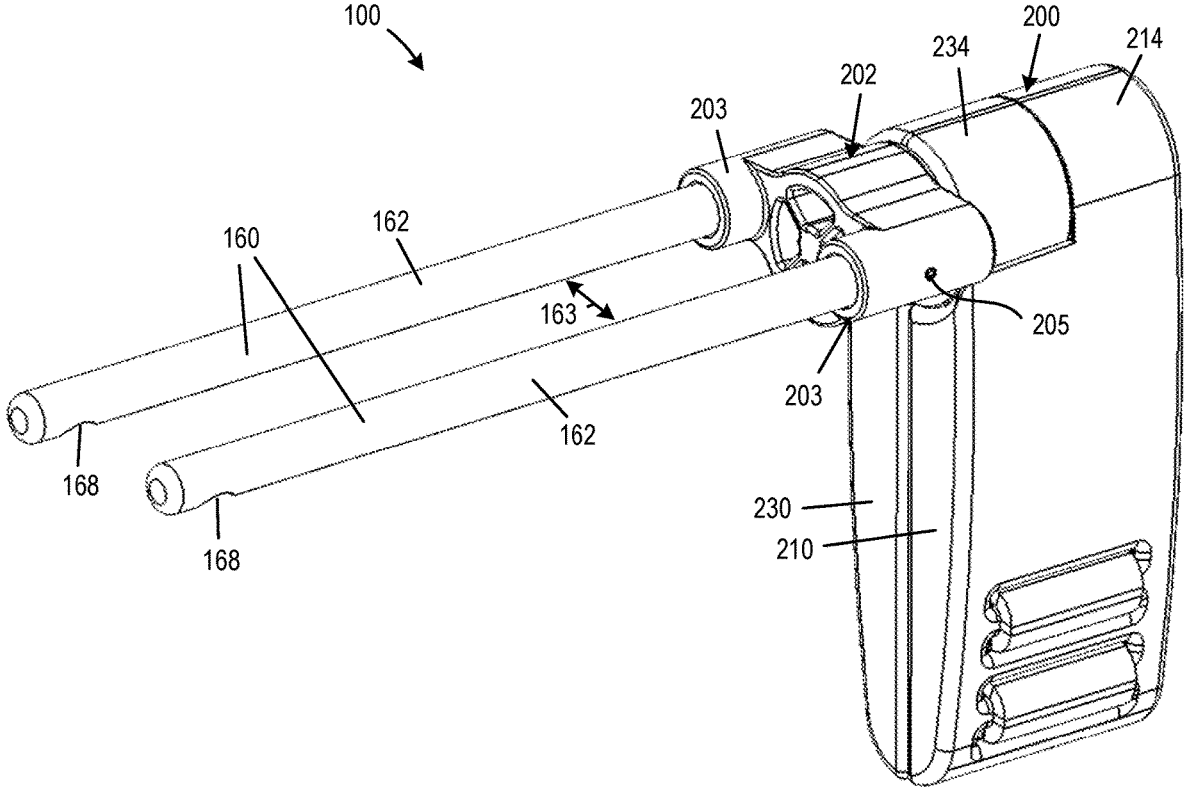
FIG. 6 illustrates a front and side perspective view of a pistol brace employing rods for the longitudinal support, in accordance with an embodiment of the present disclosure.
Figure 7:
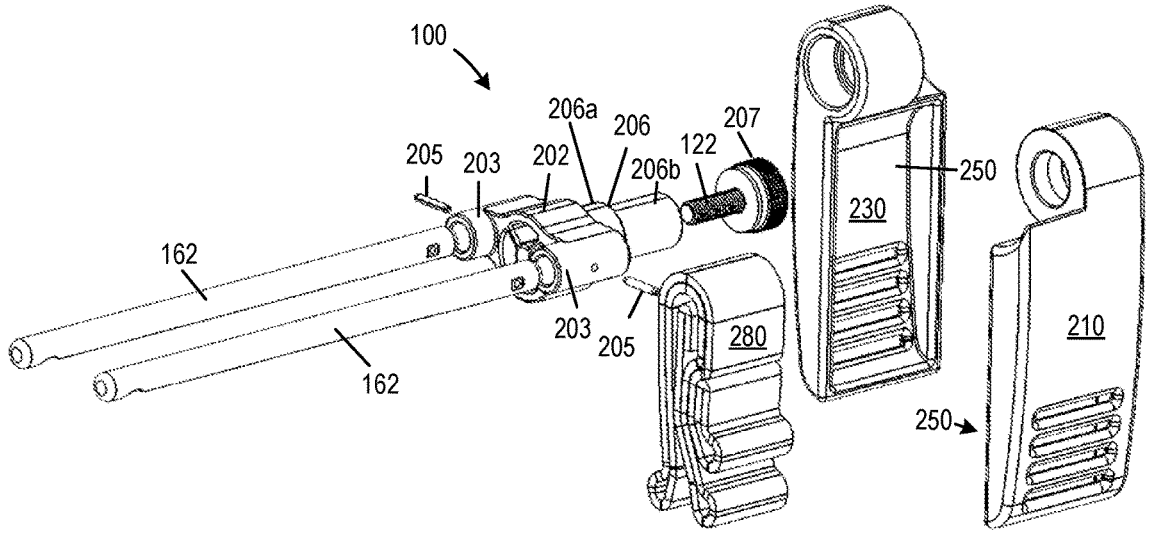
FIG. 7 illustrates an exploded, front perspective view showing components of the pistol brace of FIG. 6.

Referring to FIGS. 6 and 7, a perspective view and an exploded perspective view, respectively, illustrate pistol brace 100 in accordance with another embodiment of the present disclosure. Here, longitudinal support 160 includes a pair of rods 162 extending in a spaced-apart parallel relationship from a brace body 202. For example, rods 162 are spaced by a gap 163 sized so that rods 162 pass along opposite sides of the pistol frame 14 or receiver (shown in FIG. 18). Rods 162 can have a circular, square, semi-circular, or other cross-sectional shape. In some embodiments, for example, rods 162 have a rectangular or other non-circular cross-sectional shape to prevent rotation of the rods 162 when received a socket or the like on the pistol 10. For example, rods 162 have a semi-circular shape that are received through a sleeve or socket with a corresponding semi-circular shape. Such a non-circular shape prevents rotation of the rods 162 that may otherwise occur due to torsional forces imparted by the user when shifting positions or when firing the pistol 10.

Figure 18:
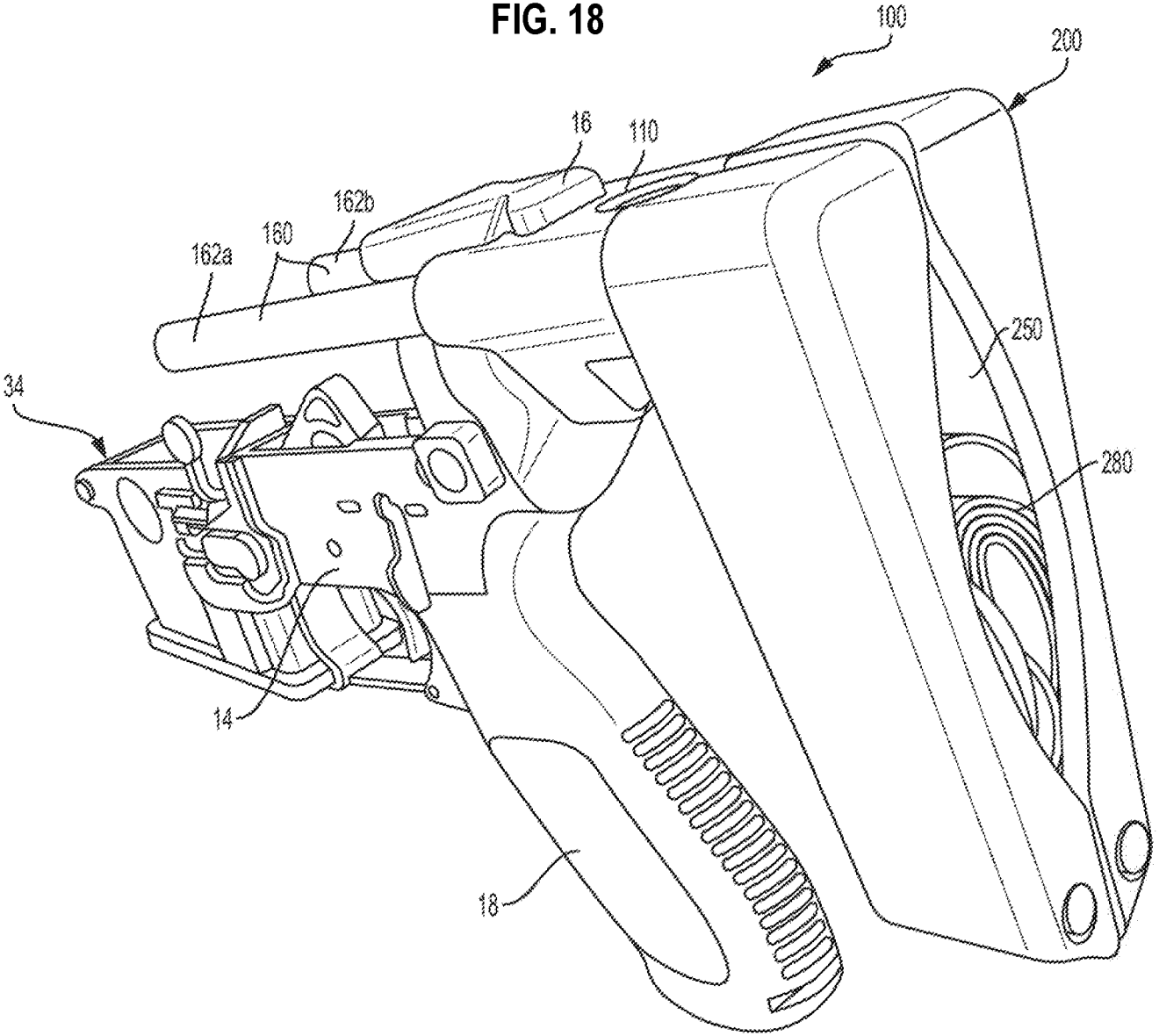
FIG. 18 illustrates a proximal end, top, and left-side perspective view of the pistol brace and lower receiver of FIG. 17, showing the pistol brace in a closed and stowed position, in accordance with one embodiment of the present disclosure.

In one embodiment, rods 162 can be received through sleeves on opposite lateral faces of the lower receiver 34 (shown in FIG. 18). Some pistols 10 or short-barreled rifles are equipped with such sleeves on opposite lateral faces of the lower receiver. Pistol brace 100 can be attached to pistol 10 by inserting rods 162 into or through the sleeves. In some such embodiments, the position of brace portion 200 can be adjusted by sliding rods 162 through the sleeves. Rods 162 can be fixed in place by tightening a set screw, engaging a tab, inserting a pin, or the like. Optionally, rods 162 include a notch, recess, flat, opening, protrusion, or other length-fixing structure 168 that may be engaged by a fastener, catch, or other structure. When equipped with length-fixing structure 168, longitudinal support 160 can be quickly adjusted to one or more pre-defined lengths.

In one embodiment, brace body 202 is constructed to connect between and attach brace portion 200 to longitudinal support 160. In one embodiment, brace body 202 attaches to or receives longitudinal support 160, and also provides a structure to which the first plate 210 and second plate 230 are mounted with the ability to pivot. In one embodiment, brace body 202 has spaced-apart receptacles 204 constructed to receive rods 162. Each rod 162 is received in receptacle 204 and retained by a fastener 205 (e.g., a set screw, a pin, or a nut), adhesive, a frictional fit, threaded engagement, or other suitable feature or combination of features. Mounting post 206 extends rearwardly from brace body 202 for attachment of brace portion 200. In some embodiments, mounting post 206 has first section 206*a* of larger diameter and second section 206*b* of smaller diameter, as discussed above. FIG. 7 shows flexible strap 280 in a folded position suitable for being stowed in the cavity 250 defined between first plate 210 and second plate 230. Similar to embodiments discussed above, first plate 210 and second plate 230 extend down from brace body 202 in opposed alignment and can rotate or pivot about mounting post 206 between an open position and a closed position.

Figure 8:
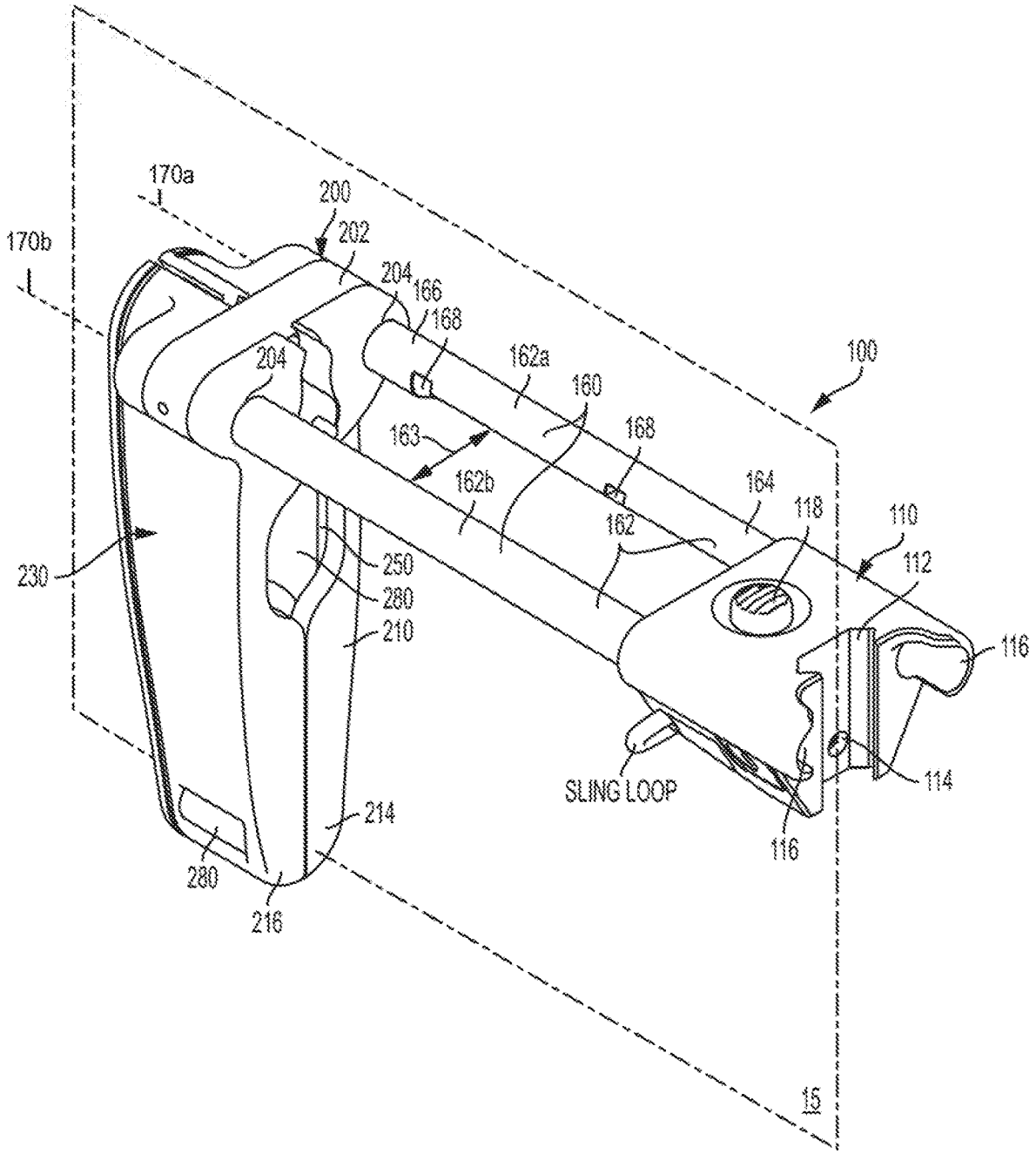
FIG. 8 illustrates a distal-end, top, and right-side perspective view showing a pistol brace, in accordance with one embodiment of the present disclosure.

Referring to FIG. 8, a perspective view shows a forearm pistol brace 100 in accordance with another embodiment of the present disclosure. Pistol brace 100 is shown in a deployed or extended position and includes a longitudinal support 160 attached to an optional mounting bracket 110, a brace portion 200 with first bolster or first plate 210 and second bolster or second plate 230 extending in opposed alignment downward from longitudinal support 160, and a flexible strap 280 connecting first plate 210 and second plate 230. In FIG. 8, brace portion 200 is shown in a closed position with flexible strap 280 retained in a folded position between first plate 210 and second plate 230.

Figure 13:
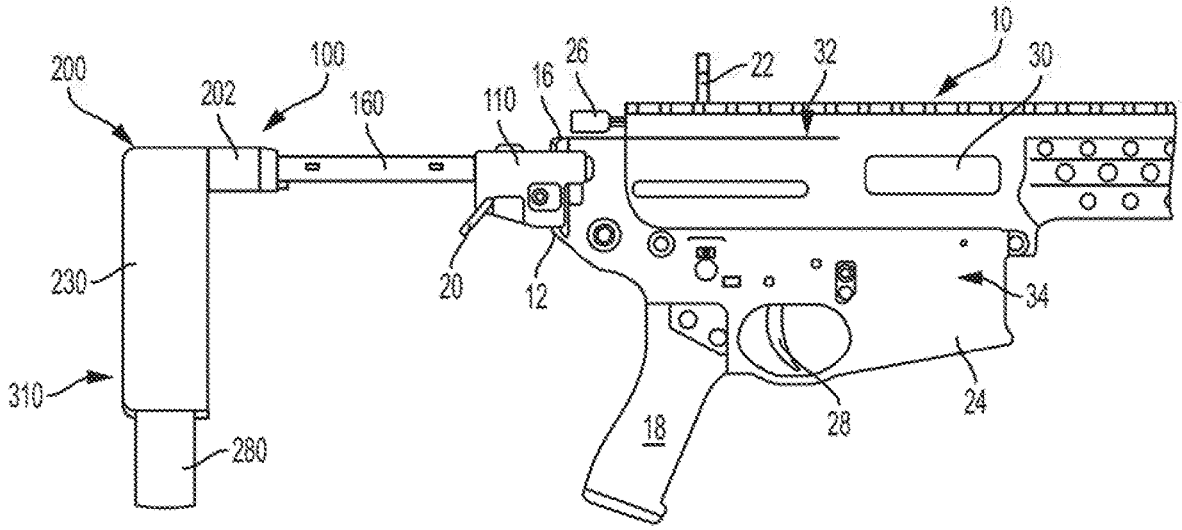
FIG. 13 illustrates a right-side elevational view of a pistol brace in an open, deployed position and installed on a pistol, in accordance with one embodiment of the present disclosure.
Figure 14:
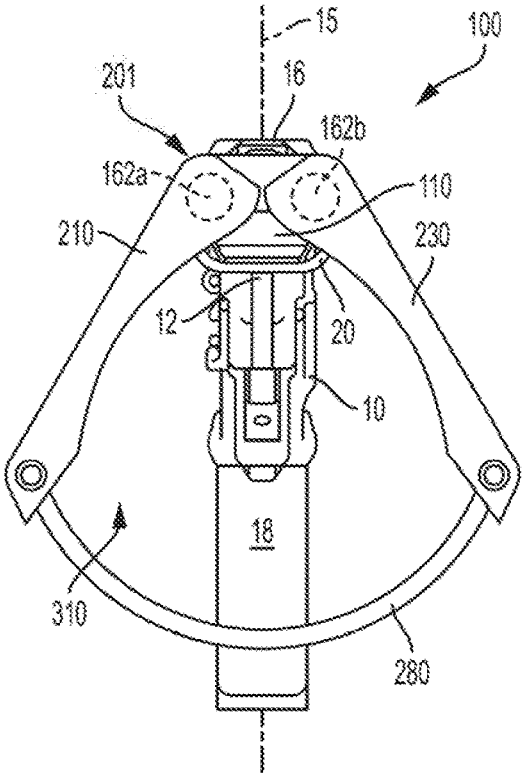
FIG. 14 illustrates a proximal-end elevational view of the pistol brace and the lower receiver shown in FIG. 13.

In one embodiment, mounting bracket 110 has an attachment feature 112 configured to attach to a rear end of a pistol frame 14 or lower receiver 34 (shown, e.g., in FIGS. 13-14). In some embodiments, for example, a mounting rail 16 is a Picatinny rail (MIL-STD-1913 rail) or other suitable rail that extends vertically along the rear end 12 of pistol frame 14. Accordingly, attachment feature 112 can be a vertical slot or clamp shaped to receive and engage mounting rail 16. To prevent mounting bracket 110 from being dislodged from pistol frame 14, mounting bracket 110 can include a locking mechanism 114, such as a fastener, pin, clamp, or other suitable structure designed to engage or lock with mounting rail 16.

In other embodiments, mounting bracket 110 can be a plate that fastens to pistol frame 14 or receiver using fasteners. For example, mounting bracket 110 is secured to pistol frame 14 in place of a stock and uses the same or similar attachment method. In yet other embodiments, mounting bracket 110 can be a sleeve or fitting configured to receive a buffer tube extending from the pistol frame 14.

In one embodiment, mounting bracket 110 defines one or more openings 116 configured to receive longitudinal support 160 therethrough. For example, when longitudinal support 160 is a pair of rods 162, mounting bracket 110 defines a pair of parallel, spaced-apart openings 116 each sized to slidingly receive one of rods 162 therethrough. In one embodiment, openings 116 are positioned so that rods 162 pass alongside the pistol frame 14 when pistol brace 100 is moved to the stowed position, where rods 162 are moved forward through openings 116, and where brace body 202 is positioned adjacent mounting bracket 110. Openings 116 may be configured as through-openings, slots, or other geometry, where each opening 116 generally guides and retains rod 162.

In some embodiments, mounting bracket 110 includes a biasing mechanism 118 that engages longitudinal support 160 to retain its position relative to mounting bracket 110. For example, biasing mechanism 118 is a spring-biased protrusion that extends partially into each opening 116 to prevent movement of rods 162. When the user presses a button, biasing mechanism 118 disengages from rods 162 to allow them to slide with relative ease through openings 116.

In some embodiments, mounting bracket 110 is fixedly attached to longitudinal support 160 at a support first end portion 164. For example, support first end portion 164 is retained in mounting bracket 100 by a frictional fit, set screw, threaded engagement, or mounting bracket 110 being formed over support first end portion 164. Longitudinal support 160 may have a fixed length between mounting bracket 110 and brace portion 200, or may have an adjustable length, such as a telescopic longitudinal support 160.

In one embodiment, longitudinal support 160 includes a pair of rods 162 spaced apart by a gap 163 and that generally extend in parallel on opposite lateral sides of the pistol's median plane 15. For example, gap 163 is sized so that rods 162 pass along opposite sides of the pistol frame 14 or receiver when pistol brace 100 is stowed or moved to a partially-stowed position with brace portion 200 positioned towards a rear end 12 of pistol 10. Rods 162 can have a circular, square, semi-circular, or other cross-sectional shape. In some embodiments, for example, rods have a square or rectangular cross-sectional shape to reduce unwanted movement of brace due to torsional forces imparted by the user.

Longitudinal support 160 includes more or fewer than two rods 162 in some embodiments. For example, longitudinal support 160 can be the pistol's buffer tube or other suitable support structure extending from rear end 12 of pistol 10. In another example, pistol brace 100 has three rods 162 arranged in a triangular relationship and extending between brace body 202 and mounting bracket 110 or pistol 10.

Optionally, longitudinal support 160 includes a notch, recess, opening, protrusion, or other length-fixing structure 168 that may be engaged by mounting bracket 110. When equipped with length-fixing structure 168, longitudinal support 160 may be quickly adjusted to one or more pre-defined length. For example, length-fixing structure 168 can be a notch in or protrusion on longitudinal support 160 that is configured to engage biasing mechanism 118 for a short, medium, and long deployment positions from mounting bracket 110, while also accommodating other intermediate positions.

In some embodiments, pistol brace 100 omits mounting bracket 110, and longitudinal support 160 instead engages a feature on pistol 10. For example, rods 162 are each received through sleeves attached to opposite lateral faces of the lower receiver 34 or upper receiver 32. Some pistols or short-barreled rifles include such sleeves on lateral faces of the lower receiver for attaching a stock or other accessory having rods 162. In similar fashion, pistol brace 100 can be attached to pistol 10 with rods 162 received by the pistol's sleeves. In such case, the position of brace portion 200 is adjusted by sliding rods 162 through the sleeves on the receiver. Rods 162 can be fixed in place by tightening a set screw, engaging a tab, inserting a pin, or the like. In another example, rear end 12 of pistol 10 defines one or more opening or socket sized to receive longitudinal support 160 (e.g., rods 162).

Brace portion 200 has a bridge or brace body 202, a first plate 210, and a second plate 230. Brace body 202 attaches to or receives longitudinal support 160. In one embodiment, brace body 202 can be a block, a plate, a bracket, or other structure attached to rods 162 and configured to maintain gap 163 between rods 162. In one embodiment, brace body 202 is fixedly attached to longitudinal support 160. For example, support second end portion 166 is received in an opening 204 in brace body 202 and retained by adhesive, a fastener (e.g., a set screw, a pin, or a nut), a frictional fit with brace body 202, threaded engagement with brace body 202, or other suitable feature. In some embodiments, first rod 162*a* and second rod 162*b* extend through brace body 202 and attach to first plate 210 and second plate 230, respectively. Accordingly, first rod 162*a* can define a first pivot axis 170*a* for first plate 210 and second rod 162*b* can define a separate second pivot axis 170*b* for second plate 230.

Figure 9:
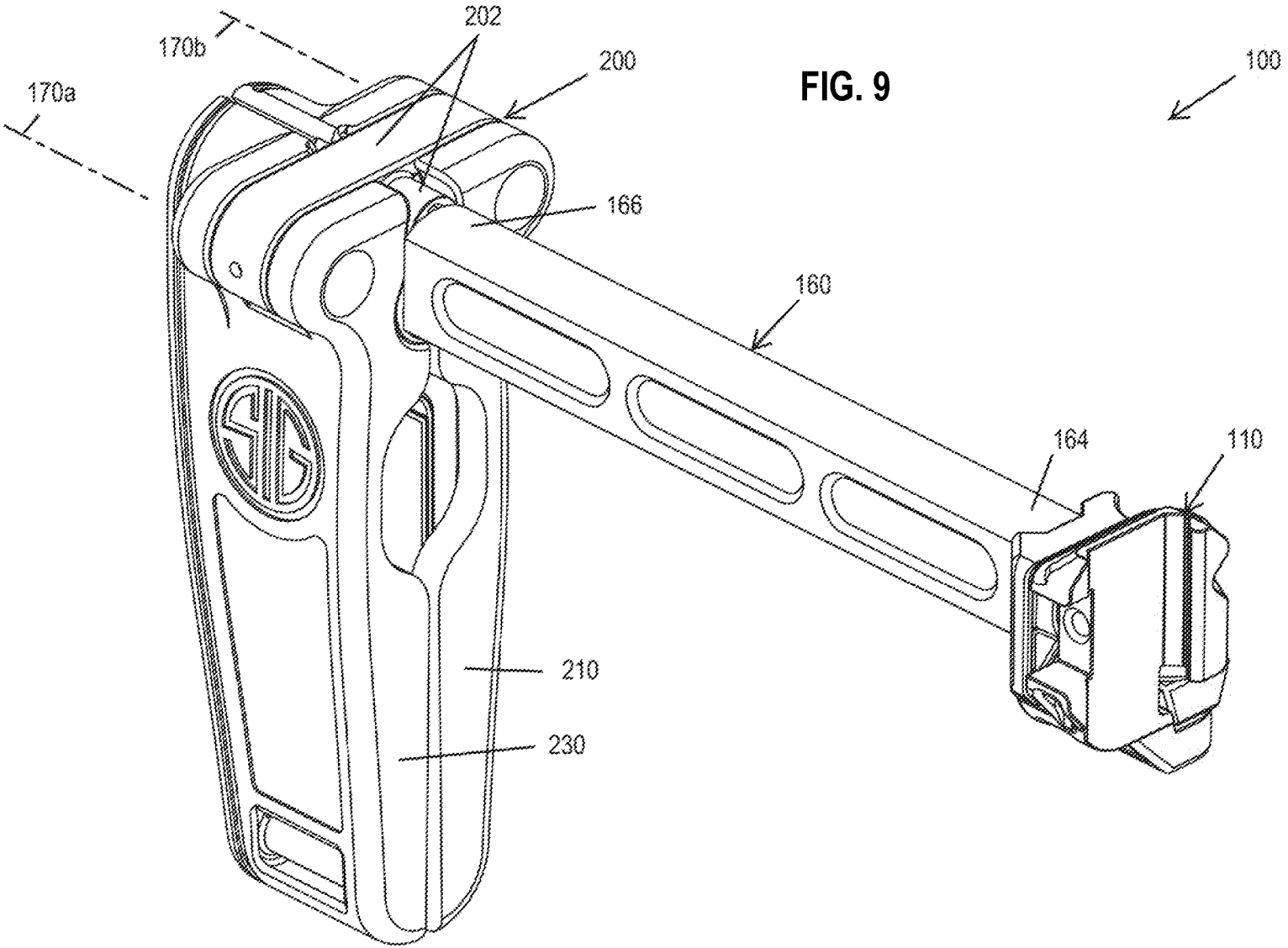
FIG. 9 illustrates a distal-end, top, and right-side perspective view showing a pistol brace in accordance with another embodiment of the present disclosure, where the first plate and second plate pivot independently about distinct pivot axes.
Figure 10:
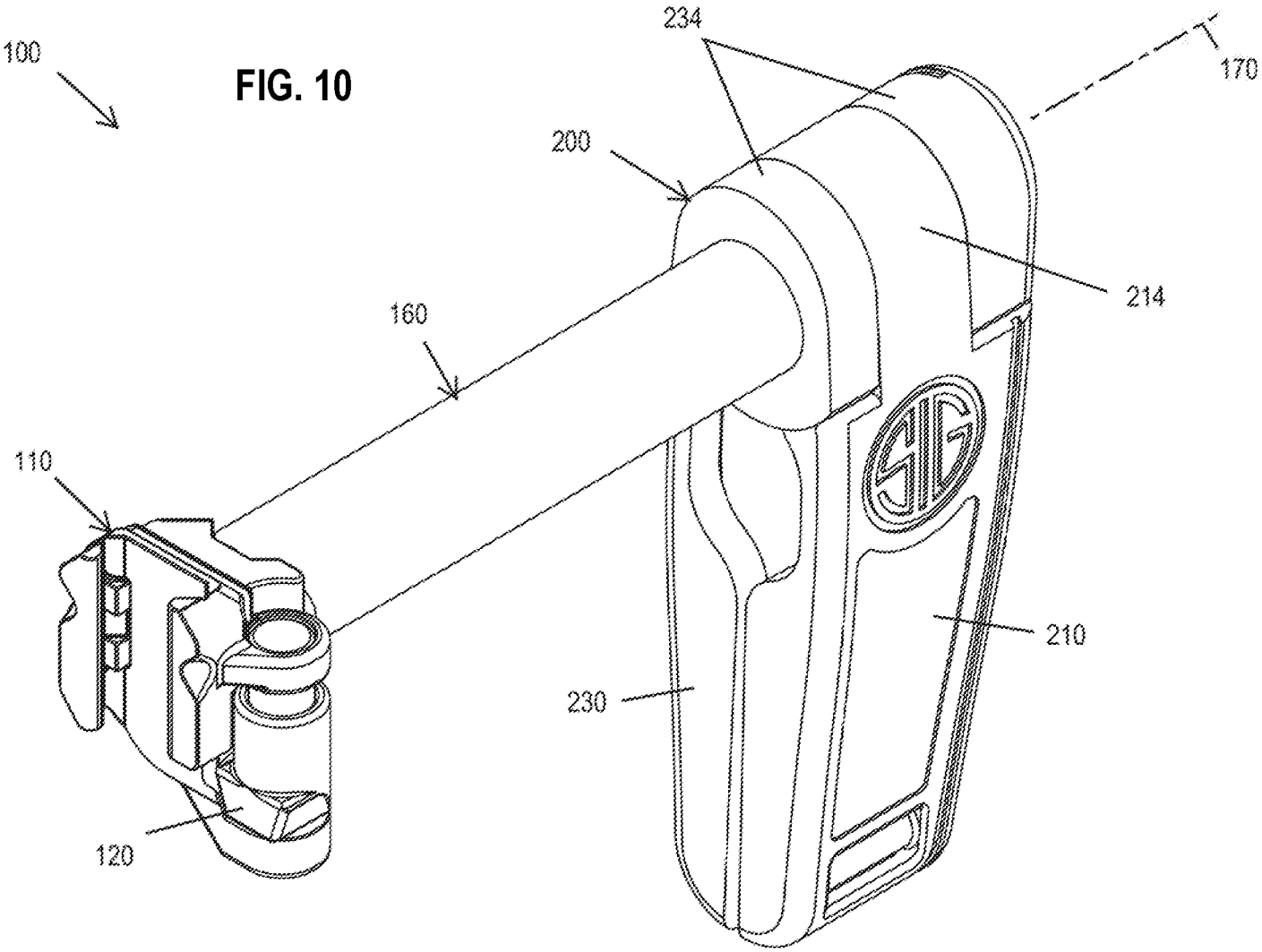
FIG. 10 illustrates a distal end and left-side perspective view showing a pistol brace in accordance with another embodiment of the present disclosure, where the first plate and the second plate can pivot independently about a common pivot axis.

Referring now to FIGS. 9 and 10, perspective views illustrate additional embodiments of pistol brace 100 in accordance with the present disclosure. Longitudinal support 160 extends between mounting bracket 110 and brace portion 200. Mounting bracket 110 is configured to engage a MIL-STD-1913 or "Picatinny" rail.

In an example shown in FIG. 9, longitudinal support 160 can be a tube, beam, rod, or other structure with a rectangular, oval, I-shape, or other cross-sectional shape. Support second end portion 166 can be secured to brace body 202 with one or more fasteners 205 with longitudinal support 160 extending between brace portion 200 and mounting bracket 110. Here, brace body 202 is configured to extend laterally from longitudinal support 160 to define first pivot axis 170*a* distinct from second pivot axis 170*b*, such as with pins extending axially through brace body 202. First pivot axis 170*a* and second pivot axis 170*b* extend generally parallel to median plane 15 and are laterally spaced from each other on opposite sides of median plane 15 (shown in FIG. 8). Accordingly, first plate 210 and second plate 230 pivot independently about distinct pivot axes 170*a*, 170*b*.

In FIG. 10, longitudinal support 160 is a hollow or solid tube with a circular cross-sectional shape. For example, the tube is received in an opening 204, such as a socket, defined in brace body 202 of brace portion 200. In another example, the tube has a closed or solid end or includes an insert (not shown) that attaches to brace portion 200 using fasteners. As shown, for example, in FIG. 10, longitudinal support 160 can be a buffer tube or similar tube attached at support first end portion 164 to mounting bracket 110. Optionally, mounting bracket 110 includes a hinge 120 so that pistol brace 100 can be folded alongside lower receiver 34 (shown in FIGS. 12-13). In other embodiments, longitudinal support 160 can be received by rear end 12 of pistol 10.

First plate 210 and second plate 230 pivot independently about longitudinal support 160, where longitudinal support 160 defines a common pivot axis 170. For example, each of first plate upper end portion 214 and second plate upper end portion 234 pivots about longitudinal support 160 extending therethrough. In one embodiment shown in FIG. 10, first plate 210 and second plate 230 extend in opposed alignment where first plate upper end portion 214 and second plate upper end portion 234 are axially offset or interleave with each other in a hinge-like fashion to pivot about longitudinal support 160. An advantage of the embodiment shown in FIG. 10 is that brace portion 200 has a narrower profile to facilitate folding along lower receiver 34.

Figure 11:
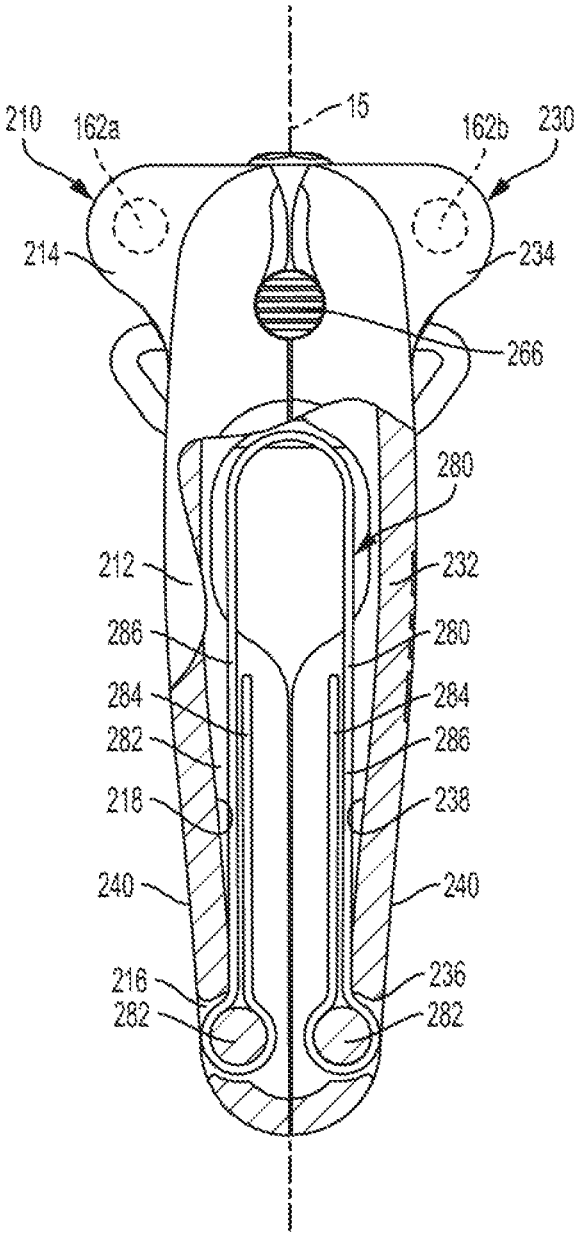
FIG. 11 illustrates a partially cutaway proximal-end elevational view of the pistol brace of FIG. 8 showing the brace portion in a closed position with the flexible strap stowed between the first and second plates, in accordance with one embodiment of the present disclosure.

Referring now to FIG. 11, a proximal-end elevational view shows pistol brace 100 of FIG. 8 with brace portion 200 in the closed position. Brace portion 200 is illustrated partially cut away to show flexible strap 280 stowed in an optional strap recess 250. First plate 210 and second plate 230 extend down from brace body 202 in opposed alignment. First plate 210 has a first plate body 212 that extends from a first plate upper end portion 214 to a first plate lower end portion 216 and has a first inside face 218 and a first outside face 220. Similarly, second plate 230 has a second plate body 232 that extends from a second plate upper end portion 234 to a second plate lower end portion 236 and has a second inside face 238 and second outside face 240.

Each of first plate 210 and second plate 230 attach to longitudinal support 160 and can pivot independently of each other. Independent movement of first plate 210 and second plate 230 enables the user's forearm 300 to deviate as needed from median plane 15 when holding or firing pistol 10 in various shooting positions. For example, when longitudinal support 160 includes rods 162, first plate upper end portion 214 is attached to first rod 162*a* and second plate upper end portion 234 is attached to second rod 162*b*. In some embodiments, first plate 210 and second plate 230 pivot about first rod 162*a* and second rod 162*b*, respectively, where rods 162 are fixed in a stationary position. In other embodiments, first plate 210 and/or second plate 230 are fixedly attached to rod 162 and pivot together with rod or with a portion of rod 162. For example, rods 162 include support second end portion 166 that rotates relative to the remaining portions of rod 162.

In some embodiments, first plate 210 and/or second plate 230 can have a fixed position relative to longitudinal support 160. For example, first plate 210 has a fixed position with first plate body 212 extending generally vertically downward to abut the user's anterior surface 302 of the forearm 300 (shown in FIGS. 19-20). In some embodiments, the fixed position is adjustable, such as when first plate 210 is movable between a plurality of predefined fixable positions.

Flexible strap 280 connects and extends between first plate lower end portion 216 and second plate lower end portion 236. Flexible strap 280 is configured to extend below and engage the user's forearm 300. In one embodiment, flexible strap 280 is webbing made of woven nylon, woven cotton, polymers, rubber, or other natural or synthetic material. Flexible strap 280 in some embodiments is elasticized, such as being made of or containing elastic, rubber, or other resilient and flexible material that enables flexible strap 280 to stretch. In yet other embodiments, flexible strap 280 is made of semi-flexible material that yields to some extent to conform to the user's forearm 300, such as hard plastic, rubber, and fiberglass.

In one embodiment, each of first plate lower end portion 216 and second plate lower end portion 236 has a rod, dowel, pin, strap loop, opening, or other strap retaining structure 282. For example, strap retaining structure 282 is a pin disposed in strap recess 250 and extending between brace front portion 246 and brace rear portion 248 of first plate 210 and second plate 230 (shown more clearly in FIG. 8). In another example, retaining structure 282 is an opening through first plate lower end portion 216 and second plate lower end portion 236. Flexible strap 280 can loop around or through strap retaining structure 282 and be fixedly attached to itself or to webbing hardware as needed. In some embodiments, flexible strap 280 is webbing that includes a hook-and-loop fastener for making quick adjustments to the length of flexible strap 280. In other embodiments, flexible strap 280 has a fixed length.

In one embodiment, flexible strap 280 is fixedly secured to first plate 210 and/or to second plate 230, where removal of flexible strap from brace portion 200 requires partial destruction of flexible strap 280 or brace portion 200. For example, one or both of strap ends 284 are secured to strap body 286 by stitching, rivets, or other permanent fastener. In one embodiment, flexible strap 280 is permanently secured to brace portion at both strap ends 284, where flexible strap 280 may have a fixed or adjustable length. In other embodiments, flexible strap 280 is permanently secured to one of first plate 210 or second plate 230 at a corresponding strap end 284, where flexible strap 280 can have an adjustable length with one strap end 284 that is not permanently attached. As such, removal of flexible strap 280 from brace portion 200 requires one to cut flexible strap 280, remove the fastener, or detach strap retaining structure 282 from brace. In taking these types of actions to remove flexible strap 280, the user partially destroys flexible strap 280 and/or parts of brace portion 200. When flexible strap 280 is secured to brace portion 200 in this way, such as when pistol brace 100 is configured for civilian use, the user may be deterred from removing the flexible strap 280 and subsequently shoulder-firing pistol 10, thereby objectively redesigning the firearm for purposes of the National Firearms Act.

Figure 12:
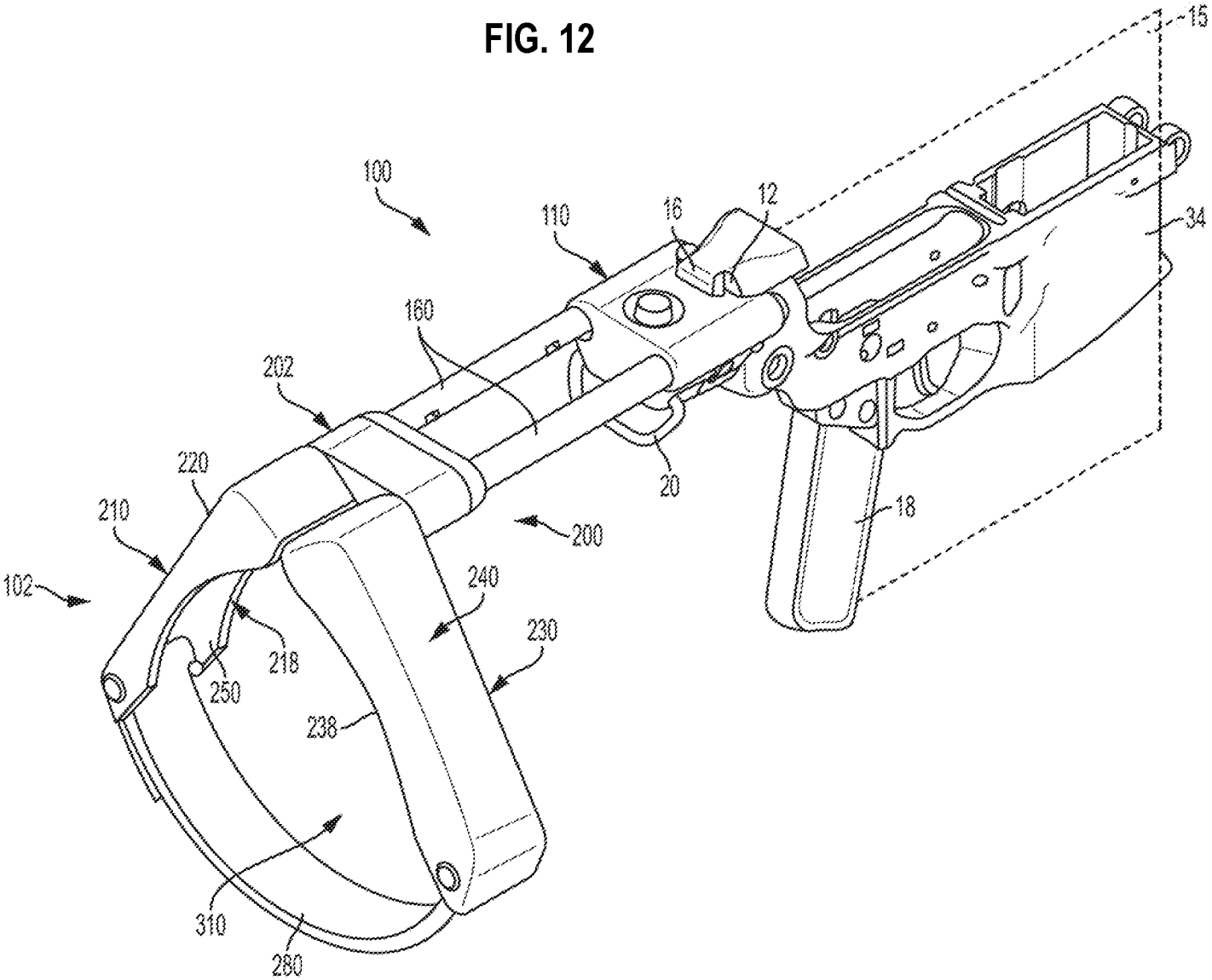
FIG. 12 illustrates a proximal-end, top, and right-side perspective view of a pistol brace in an open position and installed on a lower receiver of a pistol, in accordance with an embodiment of the present disclosure.

Referring now to FIGS. 12-14, pistol brace 100 is shown attached to a pistol 10 or pistol lower receiver 34 in accordance with an embodiment of the present disclosure. FIG. 12 illustrates a proximal-end elevational view of pistol brace 100 attached to rear end 12 of lower receiver 34 with brace portion 200 in an open position; FIG. 13 illustrates a side elevational view of pistol brace 100 installed on pistol 10 with pistol brace 100 deployed and brace portion 200 in an open position; and FIG. 14 illustrates a proximal-end elevational view of pistol brace 100 installed on lower receiver 34 with brace portion 200 in an open position.

As shown in FIG. 12, pistol brace 100 is deployed with brace portion 200 in an open position. First plate 210 and second plate 230 are pivoted laterally away from each other on opposite sides of median plane 15. Flexible strap 280 extends between first plate 210 and second plate 230 to define a forearm opening 310.

In some embodiments, first inside face 218 and/or second inside face 238 define a strap recess 250 configured to receive and house flexible strap 280 when pistol brace 100 is not in use. For example, flexible strap 280 can be folded into an inverted-U shape or other configuration that is received in strap recess 250 between first inside face 218 and second inside face 238.

First plate 210 and second plate 230 can be symmetrical or asymmetrical. In some embodiments, first inside face 218 and second inside face 238 are arcuate to engage the generally cylindrical shape of the user's forearm 300 (shown in FIGS. 19-20). In some embodiments, first inside face 218 and second inside face 238 have a different radius of curvature. For example, first inside face 218 can have a greater radius of curvature consistent with a generally flatter anterior portion 302 of forearm 300 while second inside face 238 can have a smaller radius of curvature consistent with a more rounded posterior portion 304 of forearm 300.

FIG. 13 illustrates an example of pistol 10 with a magazine well 24 positioned forward of grip 18 and trigger 28. Pistol 10 has an upper receiver 32 assembled with lower receiver 34 and includes a charging handle 26, ejection port 30, and rear sight 22. In some embodiments, mounting bracket 110 has an optional sling loop 20 pivotably attached to mounting bracket 110 for use with a sling (not shown).

In the open position, such as shown in FIG. 14, for example, first plate 210 and second plate 230 are free to pivot about longitudinal support 160 to accommodate the user's forearm 300 in forearm opening 310. With the user's hand on grip 18, the tendency of pistol 10 to tip forward and down is counteracted by flexible strap 280 engaging the user's forearm 300. As the user moves from one shooting position to another shooting position, first plate 210 and second plate 230 can pivot independently to enable the user to move the forearm 300 as needed to the left side, in line with, or to the right side of median plane 15 as viewed by the user. Since pistol brace 100 counteracts muzzle drop by flexible strap 280 engaging the user's forearm 300, some embodiments of pistol brace 100 need not have a tight fit with the forearm 300.

Figure 15:
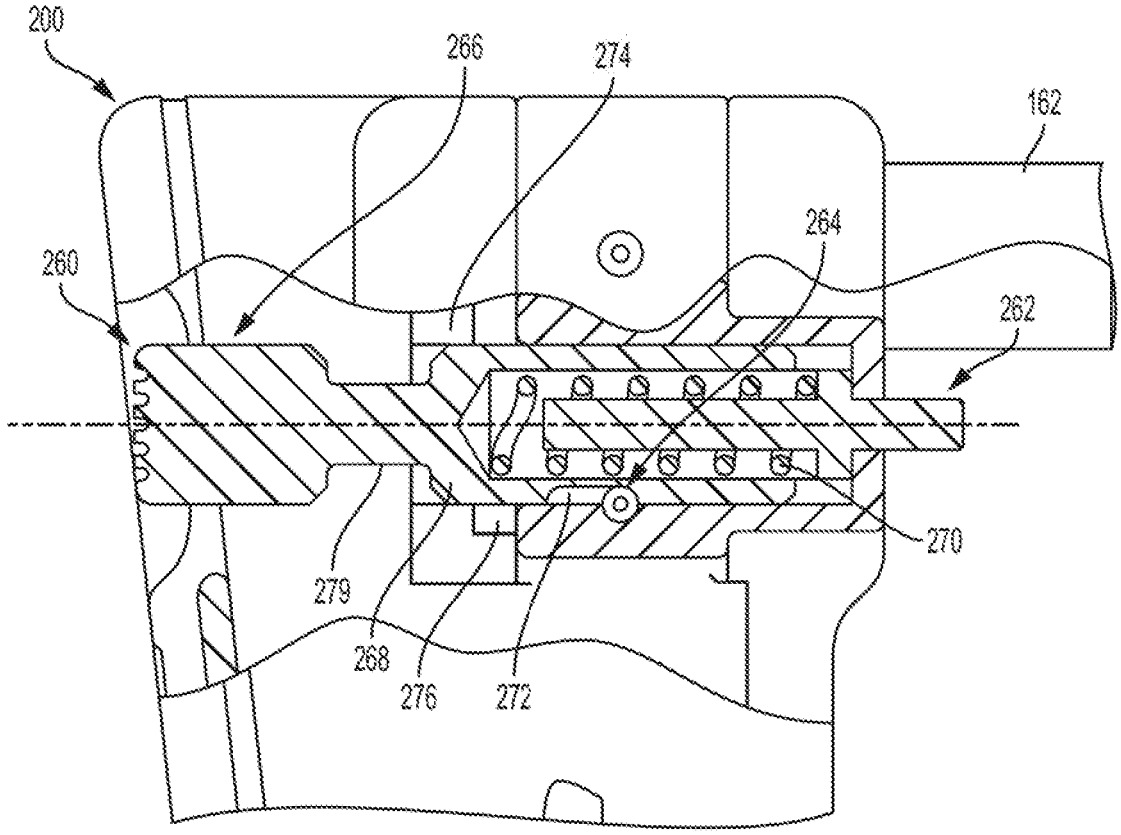
FIG. 15 illustrates a partially-cutaway side elevational view of part of the brace portion of a pistol brace, showing a brace locking assembly, in accordance with one embodiment of the present disclosure.

Referring now to FIG. 15, a side elevational view illustrates part of brace portion 200 of pistol brace 100 in accordance with an embodiment of the present disclosure. Brace portion 200 is shown partially cutaway to show components of a brace locking assembly 260 constructed to lock first plate 210 and second plate 230 in a closed position, such as shown in FIGS. 8-11. Brace locking assembly 260 includes a plunger 262, a retaining pin 264, and a release button 266. When first plate 210 and second plate 230 are in the closed position, a shoulder 268 of release button 266 engages a tooth or block 274 on first plate 210 and second plate 230 to prevent rotational motion of first plate 210 and second plate 230. Release button 266 is biased towards the locked position (e.g., proximal position as shown in FIG. 15) and maintained in the locked position by a spring 270 between plunger 262 and release button 266. In the closed position with release button 266 in the locked position (proximal), shoulder 268 of release button 266 obstruct rotation of first plate 210 and second plate 230. To unlock first plate 210 and second plate 230, the user presses release button 266 to move release button 266 to the unlocked position (e.g., distally). In the unlocked position, shoulder 268 of release button 266 occupies a void 276 defined in first plate 210 and second plate 230 and allows first plate 210 and second plate 230 to move to the open position and pivot freely while in the open position. In the unlocked position, a narrowed region or slot 269 aligns with block(s) 274 and provides space for block(s) 274 to rotate through slot 269 as the plate pivots to the open position. In other embodiments, release button 260 has a protrusion on release button 266 that occupies a void defined in first plate 210 and second plate 230 when moved to the distal or unlocked position. The void aligns with the protrusion allows first plate 210 and second plate 230 to move to the open position and pivot freely while in the open position. A retaining pin 264 extends transversely to release button 266 to stop movement of plunger 262 in the proximal or distal directions by engaging a slot wall 272, protrusion, or the like. Removing retaining pin 264 allows release button 266, spring 270, and plunger 262 to be removed from brace portion 200.

Figure 16:
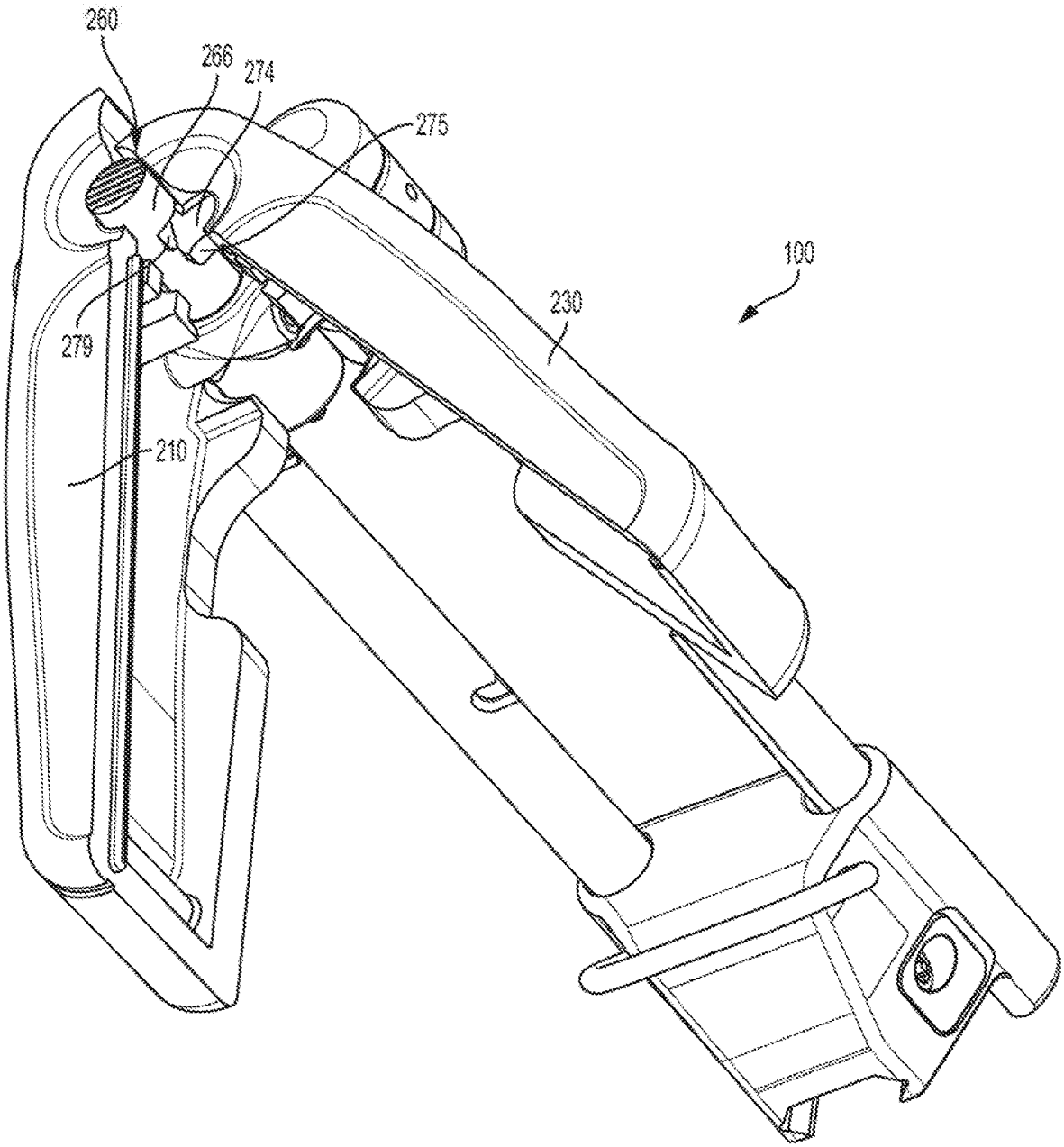
FIG. 16 illustrates a bottom perspective view of an embodiment of a pistol brace showing the brace locking assembly of FIG. 15 in an unlocked position, in accordance with an embodiment of the present disclosure.

Referring to FIG. 16, a bottom perspective view shows pistol brace 100 with release button 266 of locking assembly 260 in an unlocked position. While in the open position with release button moved to the unlocked position (distally), block 274 on each plate aligns with and can pivot through slot 279 in release button 266. Release button 266 is maintained in the unlocked position while one or both plate 210, 230 is in the open position due to block(s) 274 occupying slot 279. When first plate 210 and second plate 230 move to the closed position as shown in FIG. 11, for example, release button 266 is biased by spring 270 to return to the proximal or locked position. When release button 266 moves to the locked position, each block 274 is out of alignment with slot and positioned with block bottom surface 275 engaging release button 266 (e.g., at a top surface of release button 266), therefore preventing each of first plate 210 and second plate 230 from pivoting to the open position.

Depending on whether the intended use of pistol brace 100 is civilian, law enforcement, or military in nature, some embodiments of pistol brace 100 are configured to function both as a brace for stabilizing barrel-heavy pistols 10 in addition to being useful as a retractable stock. By locking first plate 210 and second plate 230 in the closed position as discussed above, flexible strap 280 is retained in an out-of-the-way position. Subject to compliance with firearms law, the user may use pistol brace 100 in the closed position as a stock for shoulder-firing pistol 10 by placing proximal end 102 of pistol brace 100 against the user's shoulder.

Figure 17:
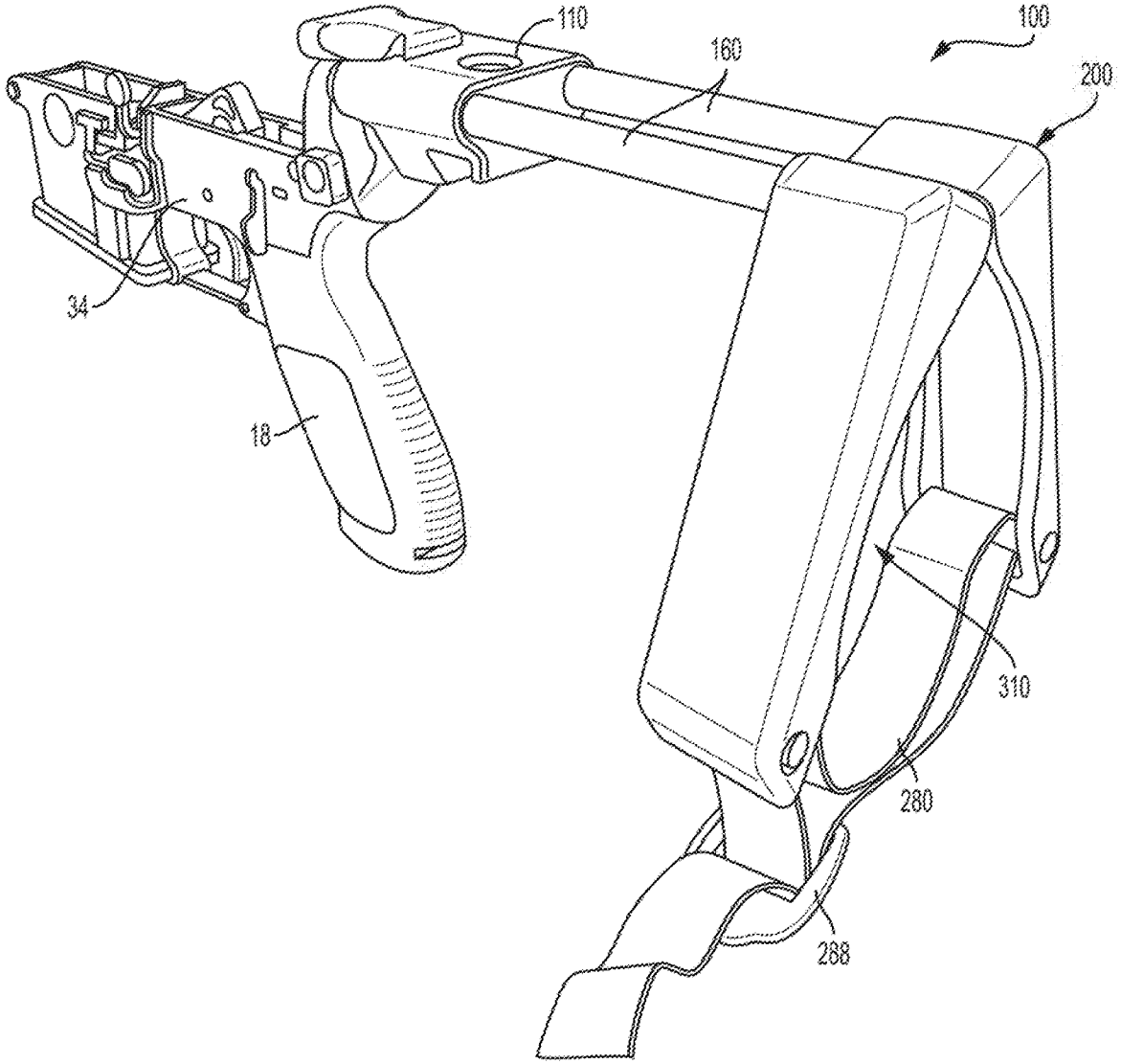
FIG. 17 illustrates a proximal end, top, and left-side perspective view of a pistol brace in an open, deployed position and installed on a lower receiver of a pistol, in accordance with one embodiment of the present disclosure.

Referring now to FIG. 17, a proximal-end perspective view shows pistol brace 100 attached to pistol lower receiver 34 in accordance with an embodiment of the present disclosure. Pistol brace 100 is in the deployed or extended position with longitudinal support 160 extended proximally of mounting bracket 110. Brace portion 200 is in the open position with first plate 210 and second plate 230 pivoted apart from each other. Flexible strap 280 is looped through strap retaining structure 282 (e.g., a pin) and includes a webbing slider 288 for adjusting the length of flexible strap 280 and therefore the size of forearm opening 310. The user may insert the forearm 300 through forearm opening 310 to grasp grip 18.

FIG. 18 illustrates a proximal-end perspective view of pistol brace and pistol frame 14 of FIG. 17, where pistol brace 100 is in a stowed position. Brace portion 200 has been moved distally to abut or be positioned closely adjacent mounting bracket 110. Rods 162 of longitudinal support 160 extend alongside pistol frame 14 without interfering with operation of pistol 10, such as fire control, safe/fire selector, ejection port, charging handle, and other features. First plate 210 and second plate 230 may be pivoted out of the way for the user to grasp grip 18 and fire pistol 10.

Figure 19:
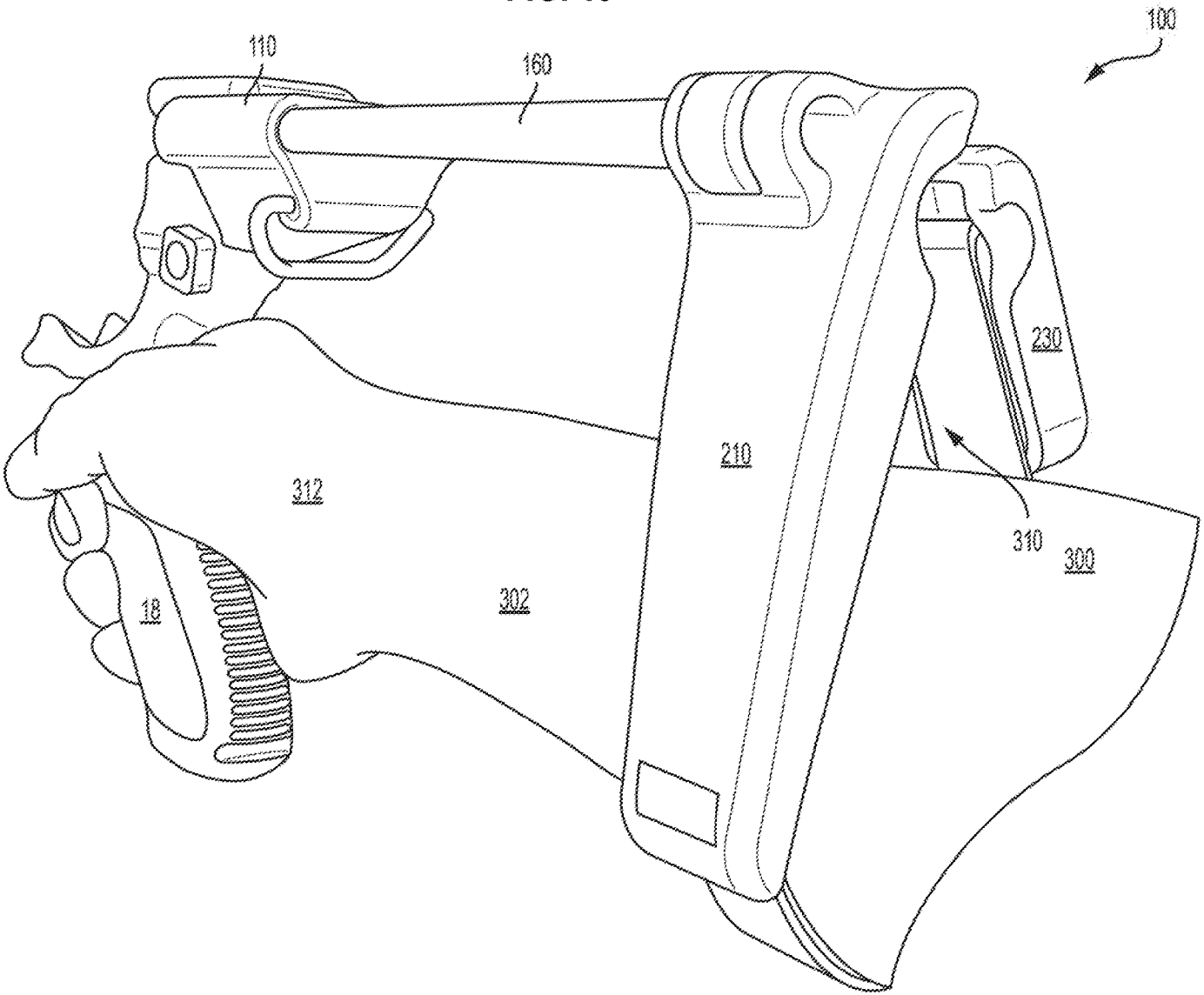
FIG. 19 illustrates a proximal-end and left-side perspective view of a pistol brace attached to part of a lower receiver in use by a user, in accordance with an embodiment of the present disclosure.

FIG. 19 illustrates a proximal-end and side perspective view of pistol brace 10 in use with a user gripping grip 18 of part of pistol 10. Longitudinal support 160 is extended with brace portion deployed and open to receive the user's forearm 300. Forearm 300 extends through forearm opening 310 and the user grasps grip 18 with the wrist 312 slightly extended. Second plate 230 is pivoted from median plane 15 more than first plate 210 as consistent with a shooting position in which pistol 10 is held in front of the user at eye level. Flexible strap 280 extends against forearm 300 between first plate 210 and second plate 230 to aid the user in supporting pistol 10.

Figure 20:
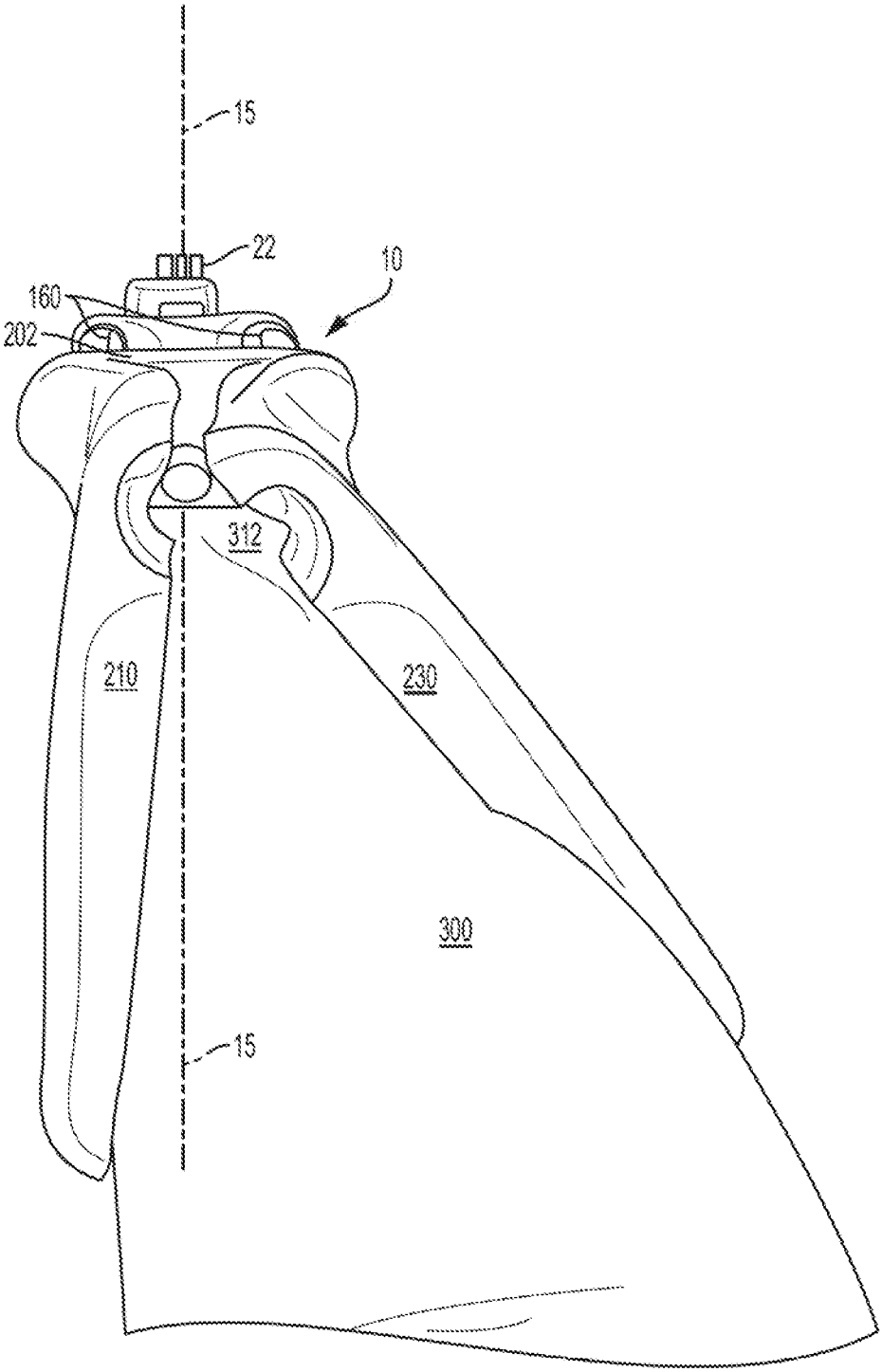
FIG. 20 illustrates a proximal-end view from the user's perspective of the pistol brace and lower receiver of FIG. 19, showing the position of the brace portion, user's forearm, and sights in relation to the pistol's median plane, in accordance with an embodiment of the present disclosure.

FIG. 20 illustrates a proximal-end view of one embodiment of pistol brace 100 as approximately viewed by the user while holding pistol 10 in a shooting position with pistol 10 in an upright orientation and with the user's arm fully extended in front of the user (e.g., an isosceles stance). Forearm 300 is offset to the right of median plane 15 as it extends through forearm opening 310 to grasp grip 18 with wrist 312 slightly extended. This position of forearm 300 relative to median plane 15 is desirable in order for the user to properly align the user's eye with sights 22 along the barrel of pistol 10.

In use, embodiments of pistol brace 100 facilitate the user in supporting and using a pistol 10, particularly pistols 10 that are barrel-heavy. Embodiments of pistol brace 100 advantageously enable the user to position the forearm 300 for proper sight alignment when holding or shooting pistol 10 in various conventional shooting positions. Unlike prior-art braces, first plate 210 and second plate 230 can pivot independently about pivot axes 170*a*, 170*b*, respectively, or about common pivot axis 170, thereby allowing the user's forearm 300 to move laterally away from median plane 15 of pistol as needed. In addition to accommodating various shooting positions, brace portion 200 enables use by left-handed or right-handed shooting without the need to reconfigure pistol brace 100.

Embodiments of pistol brace 100 also facilitate stowage and protection of flexible strap 280 between first plate 210 and second plate 230 when not in use. Strap recesses 250 in first plate 210 and/or second plate 230 enable flexible strap 280 to be folded and retained out of the way of the user. Some embodiments of pistol brace 100 include brace locking assembly 260 to lock the first plate 210 and second plate 230 in the closed position. In the locked position, flexible strap 280 is retained between first plate 210 and second plate 230 and pistol brace 100 has a convenient configuration for being moved as desired to the stowed position adjacent rear end 12 of pistol 10 or being removed from pistol 10. Also, with flexible strap 280 conveniently stowed and brace portion 200 in the locked position, pistol brace 280 may effectively function as a stock when such use is permitted by law.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

We claim:

1. A pistol brace for use with a pistol having a frame with a rear end portion and defining a median plane, the pistol brace comprising:

a longitudinal support configured to attach to a frame of a pistol and extend rearwardly from the pistol along the median plane;

a first plate with a first plate upper end portion and a first plate body, wherein the first plate upper end portion is attached to and pivots about the longitudinal support with the first plate body extending transversely from the longitudinal support, and wherein the first plate is pivotable about a first pivot axis extending through the first plate upper end portion, the first pivot axis extending along the longitudinal support; and a second plate with a second plate upper end portion and a second plate body, wherein the second plate upper end portion is attached to and pivots about the longitudinal support with the second plate body extending transversely from the longitudinal support in opposed alignment with the first plate, and wherein the second plate is pivotable independently of the first plate about a second pivot axis extending through the second plate upper end portion, the second pivot axis extending along the longitudinal support.

2. The pistol brace of claim 1, wherein the first pivot axis is distinct from the second pivot axis.

3. The pistol brace of claim 1 further comprising:

a flexible strap extending through the first plate lower end portion and the second plate lower end portion, the flexible strap at least in part defining a forearm passageway sized for a forearm of a user when the first plate lower end portion and the second plate lower end portion are pivoted apart from each other in an open position.

4. The pistol brace of claim 3, wherein the flexible strap is permanently secured to at least one of the first plate and the second plate.

5. The pistol brace of claim 1, wherein the longitudinal support comprises a first rod and a second rod extending in a spaced-apart parallel relationship.

6. The pistol brace of claim 5 further comprising a mounting bracket attached to the first rod and the second rod, wherein the mounting bracket slidably receives the first rod and the second rod, thereby permitting the first plate and the second plate to be moved between (i) a stowed position in which the first plate and the second plate are positioned adjacent the mounting bracket, and (ii) an extended position in which the first plate and the second plate are extended rearwardly from the mounting bracket by the longitudinal support.

7. The pistol brace of claim 5, wherein the first rod is received by the first plate upper end portion and defines the first pivot axis, and wherein the second rod is received by the second plate upper end portion and defines the second pivot axis.

8. The pistol brace of claim 5, wherein the longitudinal support includes a brace body secured to a proximal end portion of the longitudinal support, the brace body extending laterally between the first rod and the second rod.

9. The pistol brace of claim 1 further comprising:

a mounting bracket attached to the longitudinal support and configured to engage the frame of the pistol.

10. The pistol brace of claim 9, wherein the mounting bracket is configured to engage a mounting rail on the rear end portion of the pistol.

11. The pistol brace of claim 1, wherein one or both of the first plate and the second plate has a fixed position relative to the median plane, wherein in the fixed position, one or both of the first plate and the second plate is prevented from pivoting.

12. The pistol brace of claim 11, wherein the fixed position is releasable.

13. The pistol brace of claim 12, wherein the fixed position is a closed position with a first inside surface of the first plate facing and closely adjacent a second inside surface of the second plate.

14. The pistol brace of claim 13, wherein the closed position is selectively lockable by a brace locking assembly.

15. The pistol brace of claim 1 further comprising a pistol connected to a distal end portion of the longitudinal support.

16. The pistol brace of claim 15, wherein the pistol comprises a lower receiver and an upper receiver and is selected from (i) a submachine gun, (ii) a pistol-caliber carbine, (iii) a short-barreled rifle, and (iv) a handgun.

17. A pistol brace for use with a pistol having a frame with a rear end portion and defining a median plane, the pistol brace comprising:

a longitudinal support configured to attach to a frame of a pistol and extend rearwardly from the pistol along the median plane;

a first plate with a first plate upper end portion and a first plate body, wherein the first plate upper end portion is pivotably attached to the longitudinal support with the first plate body extending transversely from the longitudinal support, and wherein the first plate is pivotable about a first pivot axis extending through the first plate upper end portion, the first pivot axis extending along the longitudinal support; and a second plate with a second plate upper end portion and a second plate body, wherein the second plate upper end portion is pivotably attached to the longitudinal support with the second plate body extending transversely from the longitudinal support in opposed alignment with the first plate, and wherein the second plate is pivotable independently of the first plate about a second pivot axis extending through the second plate upper end portion, the second pivot axis extending along the longitudinal support, wherein the first pivot axis is the same as the second pivot axis.

18. The pistol brace of claim 17, wherein a proximal end portion of the longitudinal support includes a mounting post received through the first plate upper end portion and the second plate upper end portion.

19. A pistol brace for use with a pistol having a frame with a rear end portion and defining a median plane, the pistol brace comprising:

a longitudinal support configured to attach to a frame of a pistol and extend rearwardly from the pistol along the median plane;

a first plate with a first plate upper end portion and a first plate body, wherein the first plate upper end portion is pivotably attached to the longitudinal support with the first plate body extending transversely from the longitudinal support, and wherein the first plate is pivotable about a first pivot axis extending through the first plate upper end portion, the first pivot axis extending along the longitudinal support;

a second plate with a second plate upper end portion and a second plate body, wherein the second plate upper end portion is pivotably attached to the longitudinal support with the second plate body extending transversely from the longitudinal support in opposed alignment with the first plate, and wherein the second plate is pivotable independently of the first plate about a second pivot axis extending through the second plate upper end portion, the second pivot axis extending along the longitudinal support; and a brace body secured to a proximal end portion of the longitudinal support and including a mounting post received through the first plate upper end portion and the second plate upper end portion.

* * * * *